US007404225B2

(12) United States Patent
Jo et al.

(10) Patent No.: US 7,404,225 B2
(45) Date of Patent: Jul. 29, 2008

(54) METHOD AND DEVICE FOR DISPLAY USE OF WASHING MACHINE

(75) Inventors: Seong Jin Jo, Changwon (KR); So Young Cho, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/320,619

(22) Filed: Dec. 30, 2005

(65) Prior Publication Data

US 2006/0101591 A1 May 18, 2006

Related U.S. Application Data

(63) Continuation of application No. 10/343,925, filed as application No. PCT/KR01/01345 on Aug. 8, 2001.

(30) Foreign Application Priority Data

| | | |
|---|---|---|
| Aug. 8, 2000 | (KR) | 2000-45923 |
| Aug. 11, 2000 | (KR) | 2000-46628 |
| Sep. 5, 2000 | (KR) | 2000-52474 |
| Sep. 6, 2000 | (KR) | 2000-52745 |
| Sep. 20, 2000 | (KR) | 2000-55232 |
| Oct. 10, 2000 | (KR) | 2000-59588 |

(51) Int. Cl.
*D06F 35/00* (2006.01)
*D06F 33/00* (2006.01)
*B08F 3/12* (2006.01)

(52) U.S. Cl. ..... 8/158; 68/3 R; 68/12.01; 68/12.02; 68/12.03; 68/12.04; 68/12.05; 68/12.23; 68/12.27

(58) Field of Classification Search ..... 68/3 R, 68/12.23, 12.01–12.05, 12.27; 8/158
See application file for complete search history.

(56) References Cited

U.S. PATENT DOCUMENTS

| | | | | |
|---|---|---|---|---|
| 4,184,347 | A * | 1/1980 | Tobita et al. | 68/12.23 |
| 4,224,615 | A | 9/1980 | Penz | |
| 4,763,493 | A | 8/1988 | Nishite et al. | |
| 4,955,213 | A | 9/1990 | Ohsugi et al. | |

(Continued)

FOREIGN PATENT DOCUMENTS

| | | |
|---|---|---|
| DE | 3133176 C1 | 10/1982 |

(Continued)

*Primary Examiner*—Michael Barr
*Assistant Examiner*—Rita R Patel
(74) *Attorney, Agent, or Firm*—McKenna Long & Aldridge LLP

(57) ABSTRACT

The present invention relates to a method and device for displaying usage guidelines of a washing machine, and more particularly, to a method and device for displaying usage guidelines of a washing machine wherein a user can be guided in all the washing processes by the respective stages. The present invention is characterized in that usages of the washing machine by the respective stages are provided to an inexperienced person who does not know well the usages, that actual processes are performed when the user follows the provided instructions, and that the user can personally check and troubleshoot simple problems which may occur when utilizing the washing machine. According to the present invention, there is an additional advantage in that various functions and usages of the washing machine can be more conveniently and efficiently utilized with the aid of a wash help.

15 Claims, 27 Drawing Sheets

U.S. PATENT DOCUMENTS

| | | | | |
|---|---|---|---|---|
| 5,076,076 | A | 12/1991 | Payne | |
| 5,124,908 | A | 6/1992 | Broadbent | |
| 5,279,134 | A | 1/1994 | Nonogaki et al. | |
| 5,400,246 | A | 3/1995 | Wilson et al. | |
| 5,694,793 | A | 12/1997 | Nishimura et al. | |
| 5,781,191 | A | 7/1998 | Mayuzumi et al. | |
| 6,208,342 | B1 | 3/2001 | Mugura et al. | |
| 6,418,424 | B1 | 7/2002 | Hoffberg et al. | |
| 6,502,265 | B2 * | 1/2003 | Blair et al. | 8/159 |
| 6,628,311 | B1 | 9/2003 | Fang | |
| 6,671,916 | B2 | 1/2004 | Herr et al. | |
| 6,739,145 | B2 * | 5/2004 | Bhatnagar | 62/127 |
| 6,750,878 | B1 | 6/2004 | Tatsuo et al. | |
| 6,928,625 | B2 | 8/2005 | Makinen | |
| 6,934,592 | B2 | 8/2005 | Hood et al. | |
| 2002/0140743 | A1 * | 10/2002 | DeLuca et al. | 345/835 |
| 2003/0168084 | A1 * | 9/2003 | Jo et al. | 134/25.1 |
| 2003/0184597 | A1 * | 10/2003 | Jo et al. | 345/810 |
| 2005/0060657 | A1 | 3/2005 | DeLuca et al. | |

FOREIGN PATENT DOCUMENTS

| | | | |
|---|---|---|---|
| DE | 4040097 | A1 | 8/1991 |
| DE | 19832757 | A1 | 6/1999 |
| DE | 198 34 230 | A1 | 2/2000 |
| EP | 0898003 | A2 | 2/1999 |
| EP | 0980929 | A1 | 2/2000 |
| EP | 1174 538 | A2 | 1/2002 |
| EP | 0 976 862 | A | 2/2002 |
| JP | 60-27882 | | 2/1985 |
| JP | 05-237285 | | 9/1993 |
| JP | 07-163787 | | 6/1995 |
| JP | 08-115120 | | 5/1996 |
| JP | 08-299674 | | 11/1996 |
| JP | 09/038379 | | 2/1997 |
| JP | 09-084989 | | 3/1997 |
| JP | 10-021037 | | 1/1998 |
| KR | 10-1994-0008597 | | 9/1994 |
| KR | 1995-0011598 | | 10/1995 |
| KR | 10-0198870 | B1 | 3/1999 |
| KR | 10-2000-0018678 | | 4/2000 |
| WO | WO 00/47808 | A1 | 8/2000 |
| WO | WO 01/96644 | A1 | 12/2001 |
| WO | WO 02/12611 | A | 2/2002 |

* cited by examiner

FIG. 5b

[When presing down relevant button]

Help button

You can view explanations of respective buttons and wash courses, brief usage guidelines thereof, washing tips, and the like.

330

My favorite making button

This button is used when you wish to wash in accordance with my favorite making wash course. Desired washing time, number of times of rinse, and spin time can be stored .

333

Return button

If you press down return button during operations of changing set values and referring to help messages, relevant operation is cancelled and returned to initial wash course menu screen.

336

METHOD AND DEVICE FOR DISPLAY USE OF WASHING MACHINE

This application is a continuation of co-pending U.S. patent application Ser. No. 10/343,925, filed Feb. 6, 2003, which claims priority to International Patent Application No. PCT/KR2001/001345 filed on Aug. 8, 2001, which claims priority to Korean Patent Application Nos. 2000-0045923 filed on Aug. 8, 2000, 2000-46628 filed on Aug. 11, 2000, 2000-52474 filed on Sep. 5, 2000, 2000-52745 filed on Sep. 6, 2000, 2000-55232 filed on Sep. 20, 2000, 2000-59588 filed on Oct. 10, 2000, all of which are incorporated by reference, as if fully set forth herein.

TECHNICAL FIELD

The present invention relates to a method and device for displaying usage guidelines of a washing machine, and more particularly, to a method and device for displaying usage guidelines of a washing machine wherein a user can be guided in all the washing processes by the respective stages.

BACKGROUND ART

When most electronic appliances are purchased by a user, owner's manuals related thereto are generally provided to the user. The owner's manuals describe usage of the electronic appliances according to the stages thereof. Thus, the user needs to fully know the usage described in the owner's manuals in order to optimally utilize the electronic appliances purchased by the user. This is true of the washing machine.

On the other hand, a great deal of electronic appliances currently sold on the market include a high performance microcomputer, a mass memory capable of storing contents even when power is turned off, a means for enabling various control operations, and the like. These electronic appliances provide various kinds of uses.

However, in order to utilize the various uses of the electronic appliances, the user should refer to the owner's manuals which have been provided to the user upon purchase of the electronic appliances, as mentioned above. But, most users simply look through the owner's manuals once or twice when they have just purchased the electronic appliances, and thus, the uses of the electronic appliances cannot but be restricted to a very general purpose.

Accordingly, the various uses of the electronic appliances cannot be fully utilized by the user or consumer, and consequently, the problem that various functions of the electronic appliances cannot be sufficiently utilized is produced.

Further, in order for the user to utilize the electronic appliances with reference to the owner's manuals, the owner's manuals should be always kept at a place near the electronic appliances, and thus, it was very troublesome to use the electronic appliances.

In particular, since the washing machine is generally installed at a separate place such as washing room or veranda, it is very troublesome to perform washing processes of the washing machine with reference to the owner's manual whenever needed.

DISCLOSURE OF INVENTION

In order to solve the above problems, the present invention proposes a washing machine having a wash help function by which various functions and uses thereof can be more conveniently and efficiently utilized. Particularly, the present invention proposes a washing machine having a wash help function by which an additional owner's manual is not needed and which is always ready for responding to the user's request. That is, the present invention proposes a washing machine having a wash help function by which various washing modes thereof can be substantially useful to a user or consumer.

Therefore, an object of the present invention is to provide a method and device for displaying usage guidelines of a washing machine wherein a wash help function thereof is added so that a user can always refer to the wash help function when necessary.

In order to achieve the above objects of the present invention, there is provided a method for displaying usage guidelines of a washing machine, comprising the steps of displaying a plurality of menus for guiding a user in all the washing processes by respective stages to assist the user to wash; and displaying the usage guidelines of a menu which the user selects among the plurality of menus.

The menus of the present invention may be constructed to inform the user of the usage guidelines of the washing machine by the respective stages and to cause actual washing processes to be performed when the user follows provided instructions.

The step of displaying the usage guidelines of the menus may comprise the steps of displaying the menus provided in accordance with use patterns of the washing machine; sequentially displaying the usage guidelines of the menu selected among the plurality of the menus; and displaying the washing process which is actually performed when the user follows the usage guidelines.

The menus of the present invention may be constructed to check and troubleshoot problems related to performance of the washing machine.

The menus of the present invention may be constructed to provide the user with features of respective courses in the washing machine.

The menus of the present invention may be constructed to allow the user to select an initial screen which is displayed when the user turns on the washing machine.

The usage guidelines of the present invention can be always referred to upon request of the user when electric power has been supplied to the washing machine.

A device for displaying usage guidelines of a washing machine for achieving the above objects of the present invention comprises a display unit for displaying a plurality of menus for guiding a user in all the washing processes by respective stages to assist the user to wash, and the usage guidelines of a menu which the user selects among the plurality of menus; a memory for storing usage guideline data of all the menus to be displayed onto the display unit; and a control means for controlling the device such that the usage guideline data stored in the memory can be displayed onto the display unit.

Further, there is provided a method for displaying usage guidelines of a washing machine, comprising the steps of displaying an initial menu for guiding a user in all the washing processes by respective stages to assist the user to wash when a special button is selected in a state where electric power is supplied to the washing machine; rotating a dial button to go into a desired item among the initial menu; pressing down the dial button to select the desired item; and displaying the usage guidelines of the selected item.

Furthermore, there is provided a method for displaying usage guidelines of a washing machine, comprising the steps of displaying an initial menu for guiding a user in all the washing processes by respective stages to assist the user to wash when a help button is selected in a state where electric power is supplied to the washing machine; displaying the usage guidelines of a menu which the user selects among the initial menu; and moving to and displaying again the initial menu when a help button is selected in the course of the displaying steps.

In addition, there is provided a method for displaying usage guidelines of a washing machine, comprising the steps of displaying an initial wash course menu for performing washing processes when electric power is supplied to the washing machine; displaying an initial menu for guiding a user in all the washing processes by respective stages to assist the user to wash when a help button is selected while the initial wash course menu is displayed; displaying the usage guidelines of a menu which the user selects among the initial menu; and moving to and displaying again the initial wash course menu when a return button is selected in the course of the displaying steps.

Also, there is provided a method for displaying usage guidelines of a washing machine, comprising the steps of performing washing processes in accordance with user's selection; pausing the washing processes; and displaying an initial menu for guiding a user in all the washing processes by respective stages to assist the user to wash when a help button is selected in a state where the washing processes are paused.

Also, there is provide a method for displaying usage guidelines of a washing machine, comprising the steps of setting one or more wash courses classified in accordance with wash patterns of the washing machine, kinds of clothes, and use conditions thereof, and storing the usage guidelines of the respective wash courses; displaying a plurality of menus for the wash courses in order to guide a user in all the stored courses by respective stages; selecting a desired course among the plurality of the course menus; and displaying the usage guidelines of the selected course.

Also, there is a method for displaying usage guidelines of a washing machine, comprising the steps of arranging a plurality of buttons for performing washing processes of the washing machine, and storing the usage guidelines corresponding to the respective buttons; selecting a desired button among the arranged buttons; and displaying the usage guidelines of the selected button.

Also, there is provided a method for displaying usage guidelines of a washing machine, comprising the steps of setting one or more wash courses classified in accordance with wash patterns of the washing machine, kinds of clothes, and use conditions thereof, and storing washing stages of the respective wash courses and the usage guidelines of the respective washing stages; displaying a plurality of menus for the stored wash courses; selecting a desired wash course among the plurality of the wash course menus; and sequentially displaying the usage guidelines of the respective washing stages of the selected wash course.

Also, there is provided a method for displaying usage guidelines of a washing machine, comprising the steps of setting one or more usage guidelines classified in accordance with pollution categories of laundry, and storing the usage guidelines corresponding to the respective pollution categories of the laundry; selecting a desired pollution category among the set pollution categories; and displaying the usage guidelines corresponding to the selected pollution category.

Also, there is provided a method for displaying usage guidelines of a washing machine, comprising the steps of setting one or more usage guidelines classified in accordance with fabric care labels, and storing the usage guidelines according to the respective care labels; selecting a desired care label among the set care labels; and displaying the usage guidelines corresponding to the selected care label.

BRIEF DESCRIPTION OF DRAWINGS

FIGS. 5*a* and 5*b* are operating flowcharts for sequentially illustrating usage guidelines corresponding to a "button explanation" menu of the wash help of the present invention.

BEST MODE FOR CARRYING OUT THE INVENTION

Hereinafter, a method and device for displaying usage guidelines of a washing machine of the present invention will be described in detail with reference to the accompanying drawings.

Figure 1A:
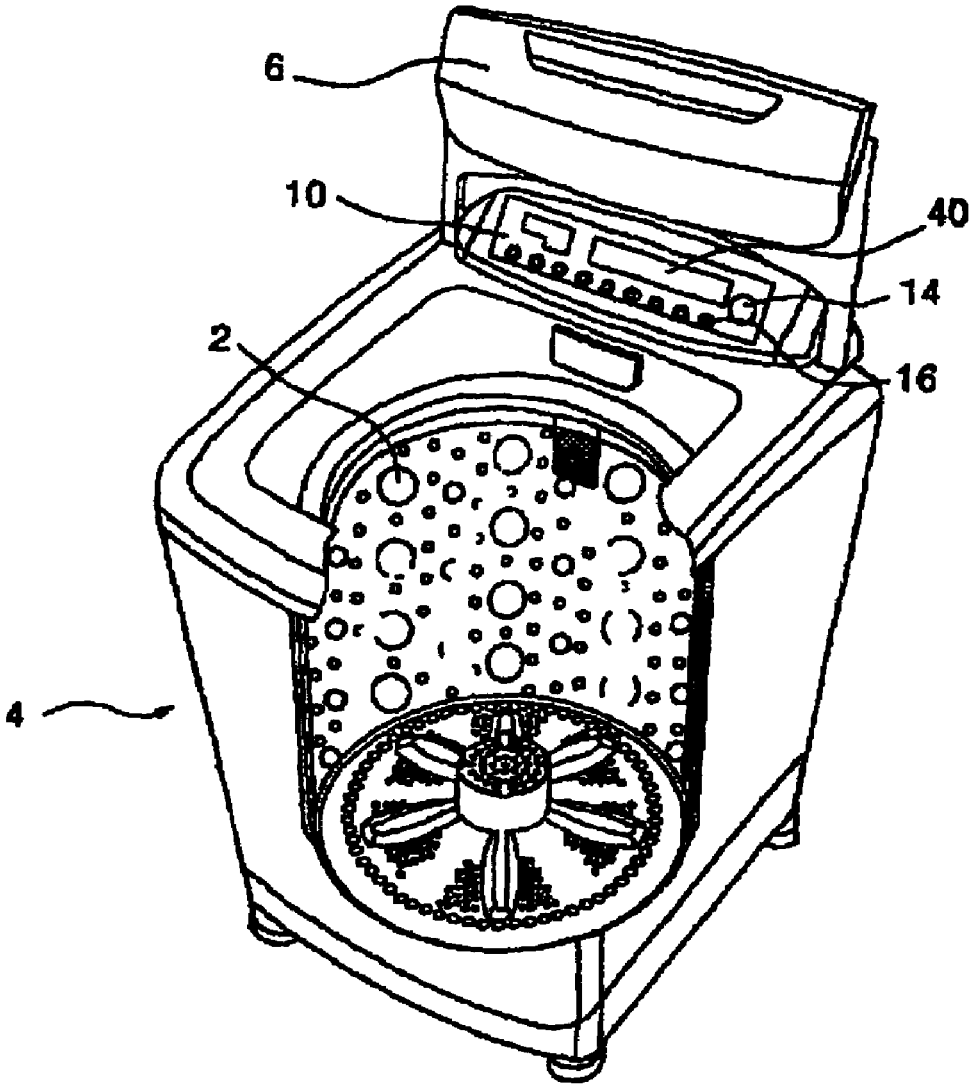
FIG. 1*a* is a perspective view of a washing machine according to the present invention.

FIG. 1*a* is a perspective view of the washing machine according to the present invention. As shown in the figure, a top cover 6 is installed at an upper face of an outer casing 4 in which a washing tub 2 is placed. A front panel 10 sloping at a predetermined angle is installed in the rear of the top cover 6. The front panel 10 is a portion for inputting a washing function that a user wishes to select or displaying a washing process performed in accordance with the inputted function to the user when washing is performed in the washing machine.

The front panel 10 includes an LCD display unit 40 for displaying usage guidelines for any menus of a wash help. Further, the panel includes various kinds of buttons such as a dial button 14 and a return button 16 which are included in the signal input unit 10 to be described later.

Figure 1B:
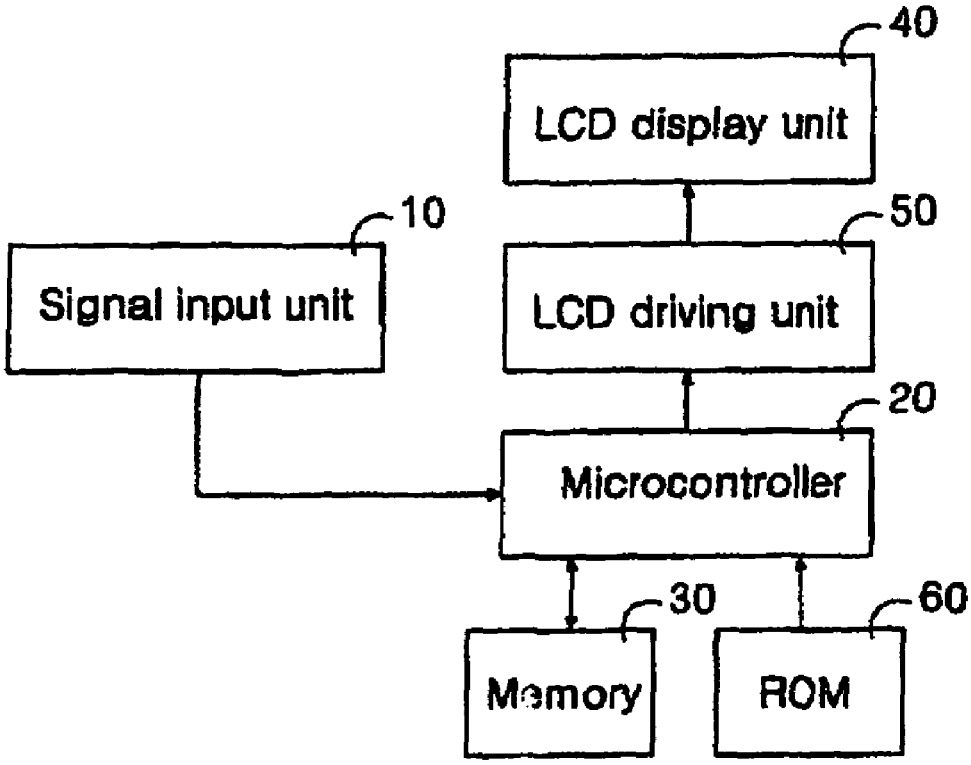
FIG. 1*b* is a block diagram showing the constitution for controlling a wash help according to the present invention.

FIG. 1*b* is a constitutional view of a device for displaying usage guidelines of the washing machine according to the present invention.

The washing machine of the present invention is characterized by a wash help function. A wash help serves to explain to the user all the washing processes according to the respective items, which include a "course explanation" menu for explaining features of the respective courses and washable clothes; a "button explanation" menu for explaining functions of selected buttons such as a wash button, a rinse button, a spin button, a reservation button, a water current button, a water level button, and a hot/cold water button; a "washing following" menu in which the usages corresponding to the respective items are explained to an inexperienced person who does not know the usage of the washing machine and the washing processes are actually performed when the user follows the instructions on the explained usages; a "washing tip" menu for explaining care labels of the clothes and providing various kinds of life information useful for washing; a "before calling for service" menu in which the user can personally check and troubleshoot problems of performance of and complaint about the washing machine when utilizing the washing machine; and an "initial screen selection" menu for selecting an initial screen.

Therefore, the device for displaying usage guidelines of the washing machine according to the present invention is provided with the signal input unit 10 including the buttons such as a wash button, a rinse button, a spin button, a reservation button, a water current button, a water level button, a cold/hot water button, a start/pause button, a help button, a my favorite making button, a return button 16, a dial button 14, and a power button. When any one of the buttons is selected through the signal input unit 10, the selection of the button is encoded and then the encoded signal is inputted to the microcontroller 20 to be described later. The micrcontroller 20 and the signal input unit 10 are in a state where commands to the respective buttons have been previously set therein.

In particular, the help button in the signal input unit 10 is an operating button for actuating the wash help which will be explained in the present invention. Further, the dial button 14 in the signal input unit 10 is an operating button for performing a function of moving a cursor (inverse image) upon rotation of a dial and for selecting an item where the cursor (inverse image) is currently positioned.

The device for displaying the usage guidelines of the washing machine according to the present invention includes a memory 30 for storing the usage guidelines for the various menus in the wash help. Data stored into the memory 30 are comprised of letters, numerals, figures, and the like included in the respective usage guidelines. Further, when the user has set the washing process at his/her own will by using the "my favorite making button," the memory 30 may hold and store the set washing process. Therefore, the data can be read from or written onto the memory 30 under the control of the microcontroller 20.

Furthermore, the device for displaying the usage guidelines of the washing machine according to the present invention includes a ROM 60 in which a control program for operating the wash help is stored. Data stored in the ROM 60 are comprised of data which cannot be arbitrarily updated by the user. For example, the data are comprised of a control program for controlling the wash help as a whole, a control program for operating the washing machine and the like, and can be only read.

The microcontroller 20 proceeds with the wash help in accordance with the wash help control program. Further, when the user selects an arbitrary menu in the wash help, the microcontroller reads the usage guidelines corresponding to the selected menu from the memory 30 and outputs the guidelines.

In addition, the device for displaying the usage guidelines of the washing machine includes the LCD display unit 40 for displaying the usage guidelines for the arbitrary menus in the wash help which are outputted under the control of the microcontroller 20, and an LCD driving unit 50 for driving the LCD display unit 40.

The usage guidelines of the washing machine according to the present invention constructed as such are indicated as follows.

Figure 2A:
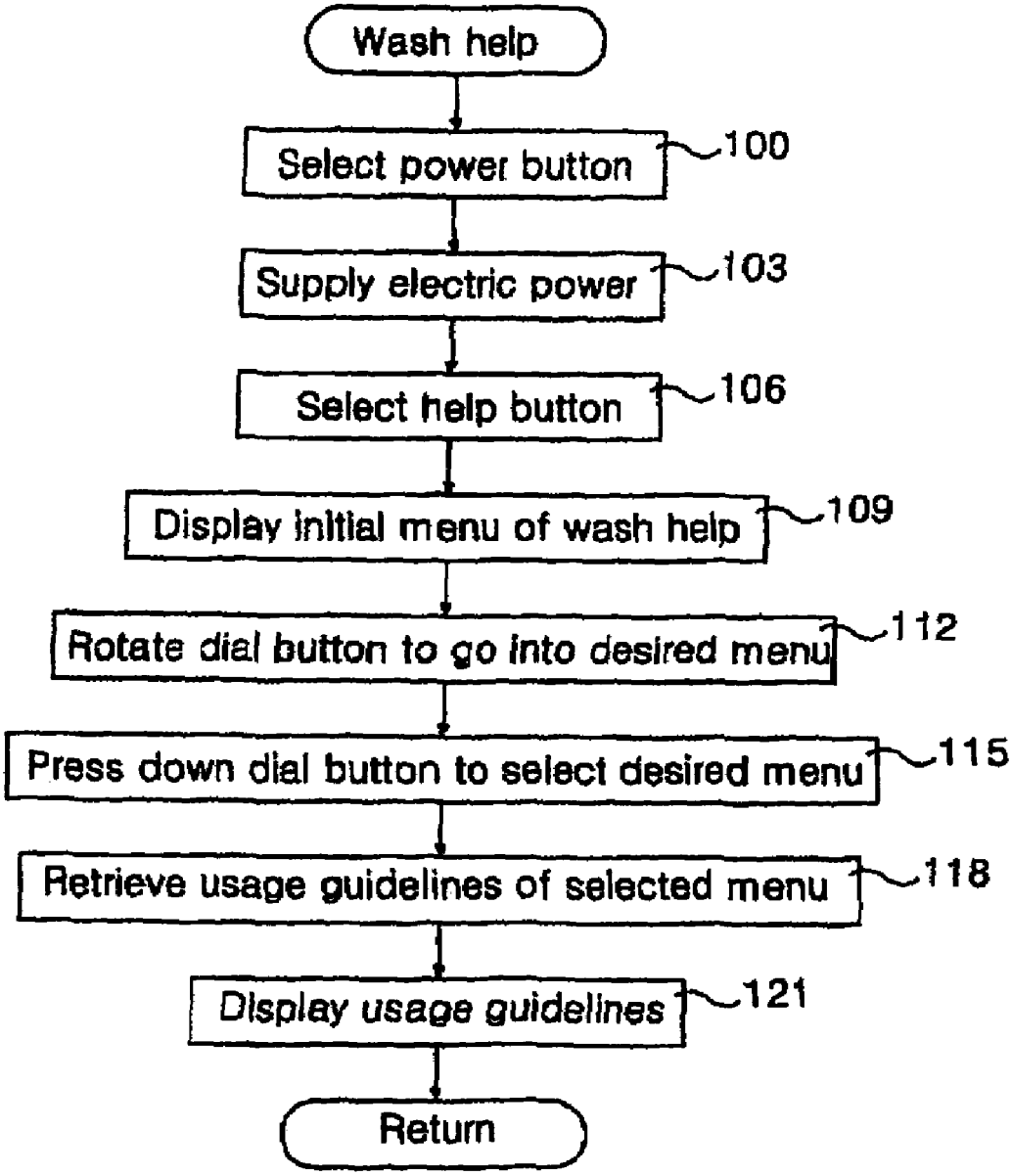
FIGS. 2*a* to 2*d* are operating flowcharts of the wash help according to the present invention.

FIG. 2*a* is an operating flowchart for illustrating the processes of the wash help according to the present invention.

When the user selects the "power button" in the signal input unit 10, a code signal corresponding to the power button is applied from the signal input unit 10 to the microcontroller 20 (step 100). When the code signal corresponding to the power button is inputted to the microcontroller 20 in step 100, electric power is supplied to respective components of the washing machine under the control of the microcontroller so that the washing machine is in a standby state where it is ready for washing (step 103).

In the standby state of step 103, the microcontroller 20 monitors whether any signals corresponding to the arbitrary buttons are inputted thereto. When the user selects the "help button" during the monitoring operation, the signal input unit 10 transfers the code signal corresponding to the help button to the microcontroller 20 (step 106).

If the help button is pressed down in step 106, the wash help starts to operate. Similarly, if any buttons for performing the arbitrary washing processes are pressed down in the standby state of step 103, the microcontroller 20 proceeds with the relevant processes.

The microcontroller 20 recognizes through the input of the help button in step 106 that the operation of the wash help is currently requested by the user. Then, the microcontroller 20 proceeds with the wash help sequentially in accordance with the control program stored in the ROM 60 for operating the wash help.

First, the microcontroller 20 reads an initial menu of the wash help and displays the initial menu onto the LCD display unit 40 (step 109).

If the initial menu of the wash help is displayed onto the LCD display unit 40 in step 109, the user moves the cursor (inverse image) to an desired item by rotating the "dial button 14" provided in the signal input unit 10 (step 112). Then, after the cursor (inverse image) has been placed on the desired item, the user presses down the "dial button 14" to select the relevant item (step 115).

If the specific item of the wash help is selected in step 115, the microcontroller 20 reads the usage guidelines of the selected item from the memory 30 (step 118). Then, the read usage guidelines are displayed onto the LCD display unit 40 to provide the user with the guidelines (step 121).

Thus, the wash help of the present invention can cause the usage guidelines of the item, which the user intends to know, to be displayed onto the LCD display unit 40 so that the user can conveniently and easily understand the guidelines.

Figure 2B:
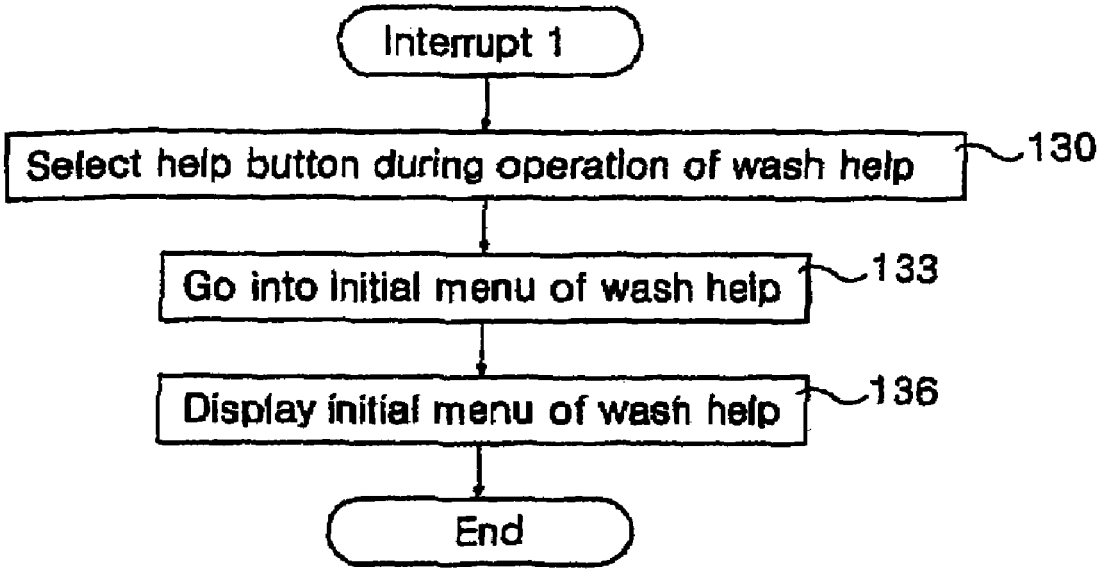
Figure 2C:
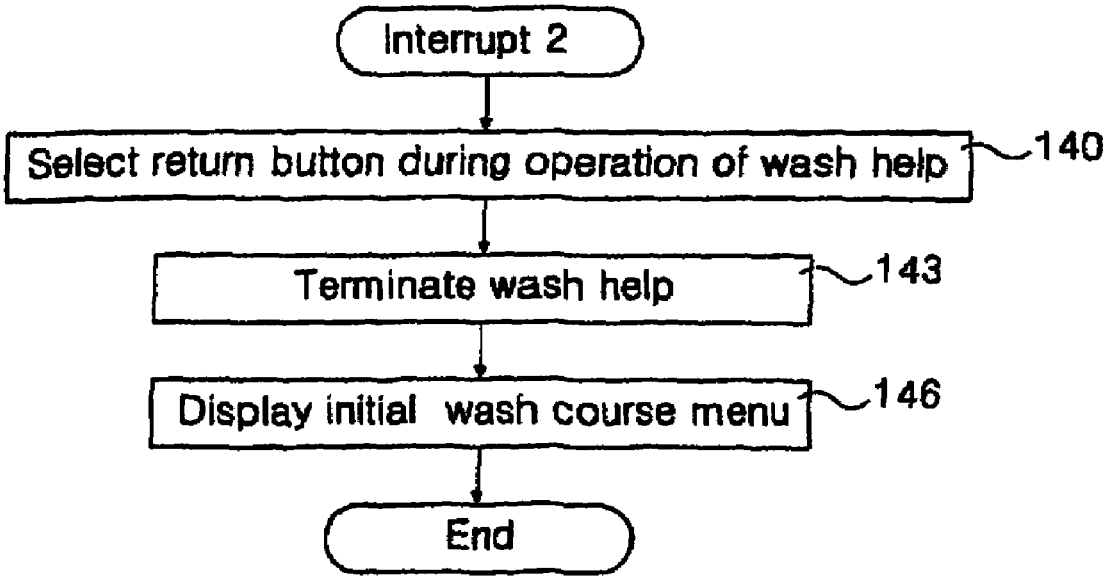
Figure 2D:
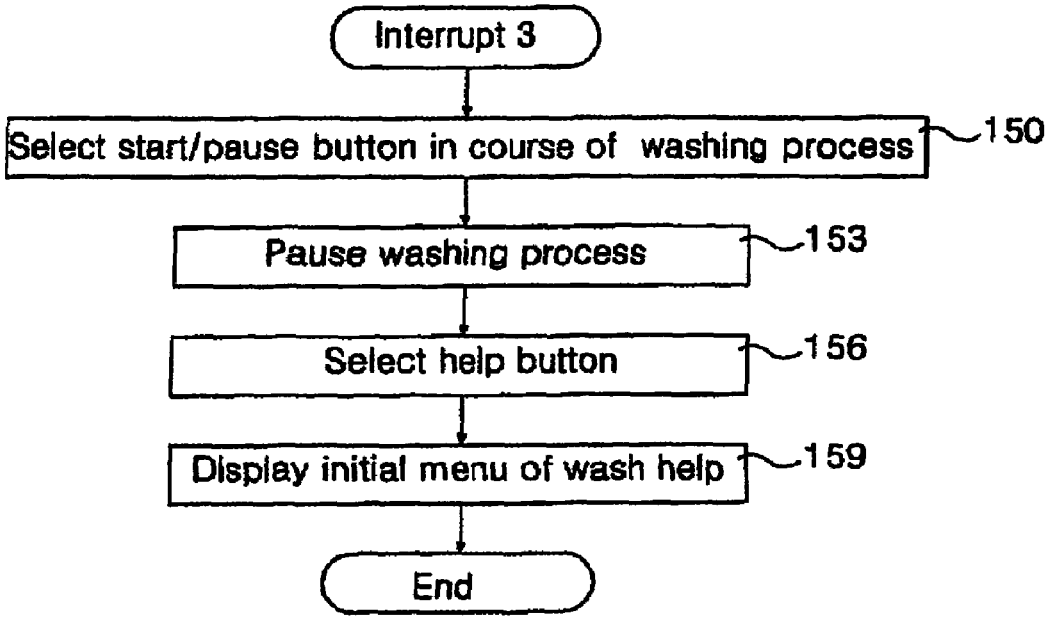

Next, FIGS. 2*b* to 2*d* are flowcharts illustrating interrupt operations for going into or out from the wash help during the operation of the wash help and during the progress of the washing process.

FIG. 2*b* shows an interrupt which is used when the user intends to cause the wash help to go into the initial menu thereof during the progress of the wash help. That is, if the user selects the "help button" during the arbitrary operation of the wash help shown in FIG. 2*a* (step 130), a currently operated stage of the wash help is ignored and it unconditionally goes into the initial menu of the wash help (step 133). Then, the initial menu of the wash help is displayed onto the LCD display unit 40 (step 136).

Thus, if the user selects the "help button" once again during the operation of the wash help shown in FIG. 2*a*, it is possible for the user to cause the wash help to go into the initial menu thereof FIG. 2*c* shows an interrupt which is used when the user intends to cause the wash help to be changed into an initial menu of a washing course for performing the washing process, during the arbitrary operation of the wash help shown in FIG. 2*a*. That is, if the user selects the "return button 16" during the arbitrary operation of the wash help shown in FIG. 2*a* (step 140), a currently operating stage of the wash help is ignored and the wash help comes to an end (step 143). Then, the standby state where the washing process can start to operate, that is, the initial menu of the washing course is displayed (step 146).

Thus, if the user selects the "return button 16" during the operation of the wash help shown in FIG. 2*a*, it is possible for the user to cause the wash help to go into the initial menu of the washing course.

Next, FIG. 2*d* shows an interrupt for going into the wash help during the washing.

If the user selects the "start/pause button" in the signal input unit 10 in a state where the washing process is in progress in accordance with a user's request or reserved operation (step 150), the current washing process of the washing machine is paused (step 153).

If the user selects the "help button" in the signal input unit 10 in such circumstances (step 156), the microcontroller 20 recognizes that the user requests the wash help, and causes the initial menu of the wash help to be displayed onto the LCD display unit 40 (step 159).

Hereinafter, the description of the operation of displaying the usage guidelines corresponding to the item selected by the user onto the LCD display unit 40 will be omitted, because it is performed in the same process as the operation shown in FIG. 2*a*.

That is, FIG. 2*d* shows the interrupt which is performed when the user intends to receive assistance of the wash help during the washing.

Next, various menus provided in the wash help of the present invention will be described in detail.

Figure 3:
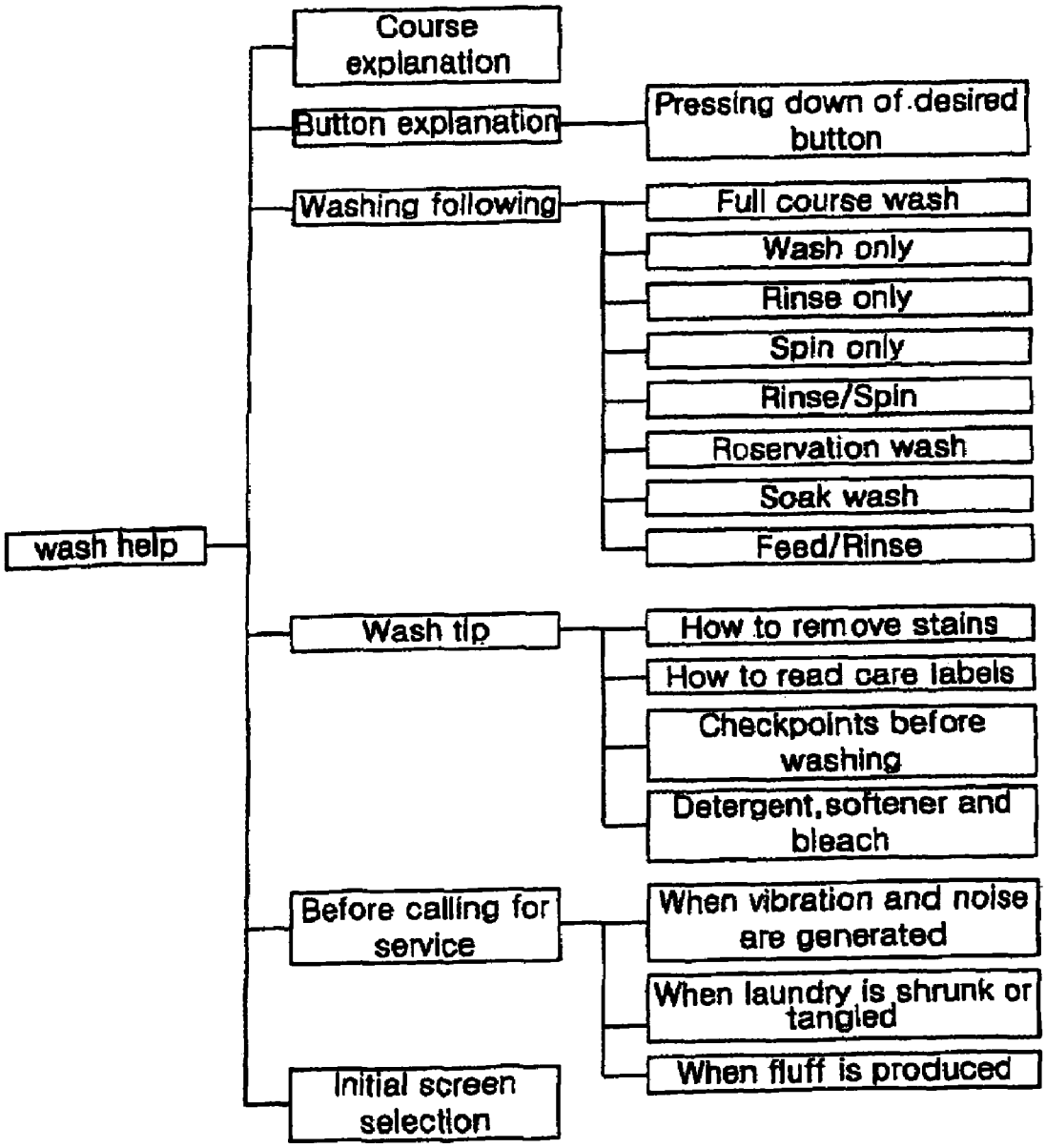
FIG. 3 is an illustrative view of a menu configuration for the wash help according to the present invention.

FIG. 3 shows an example of menus provided in the wash help according to the present invention.

Figure 4A:
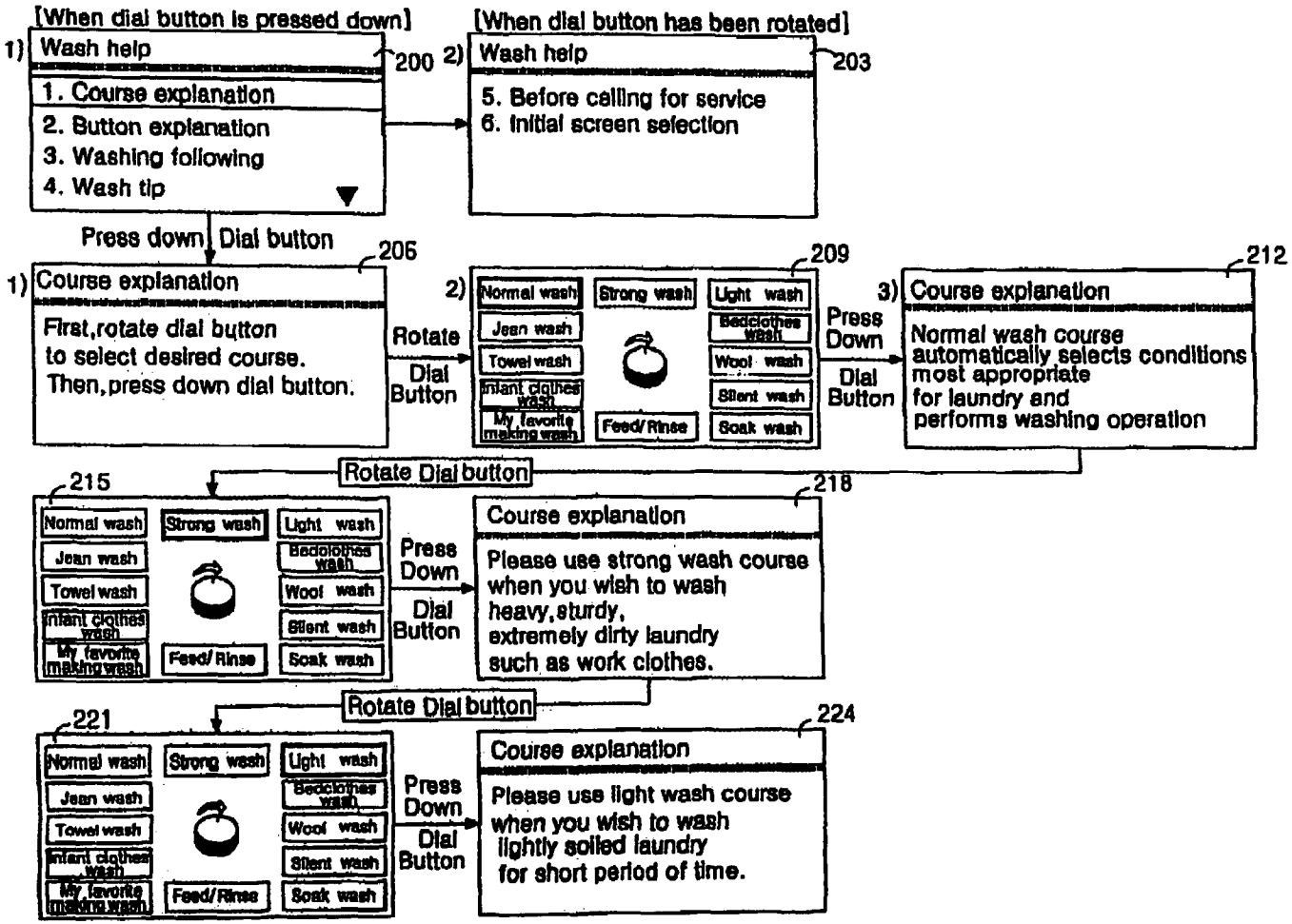
FIGS. 4*a* to 4*d* are operating flowcharts for sequentially illustrating usage guidelines corresponding to a "course explanation" menu of the wash help of the present invention.
Figure 4B:
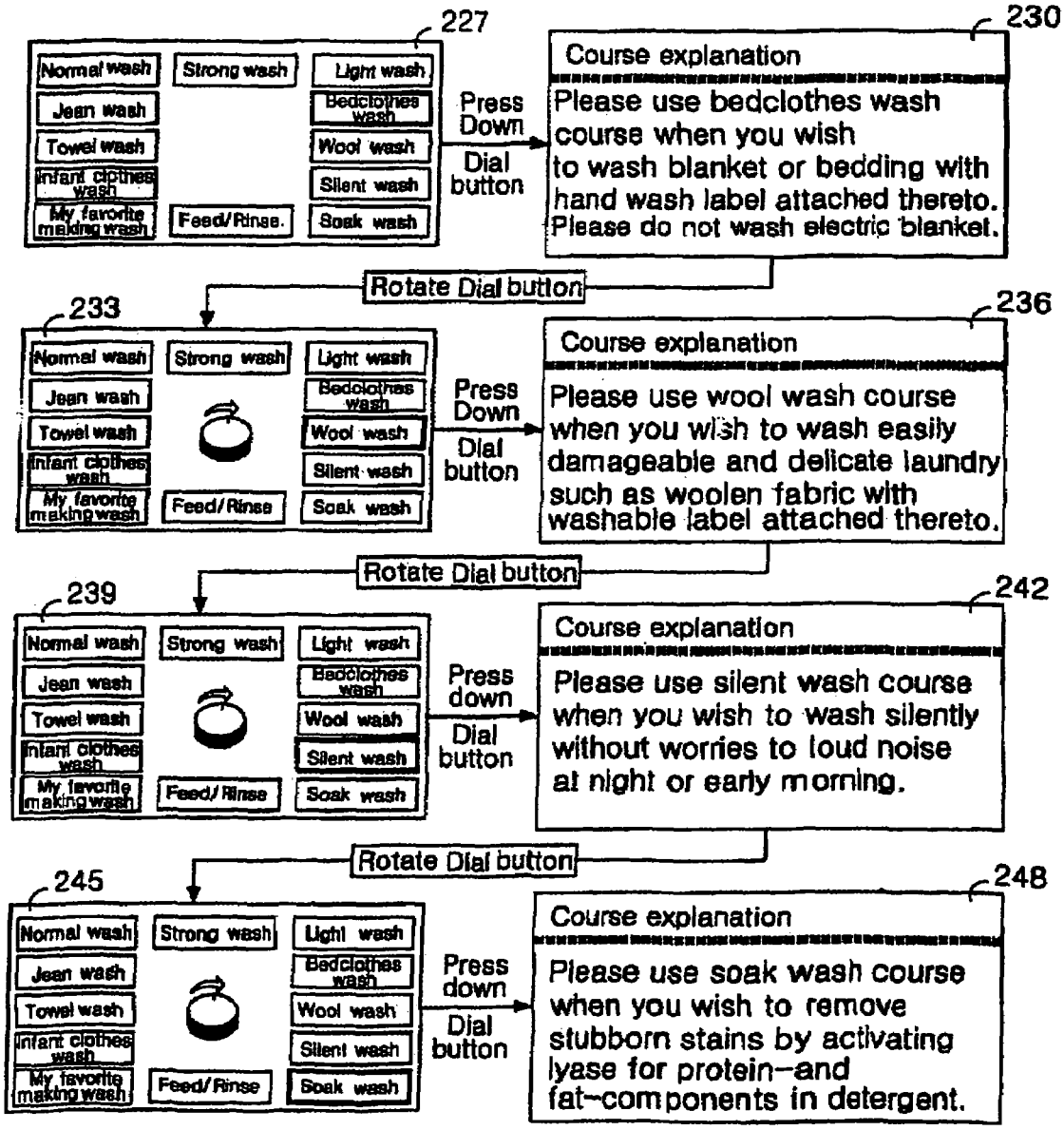
Figure 4C:
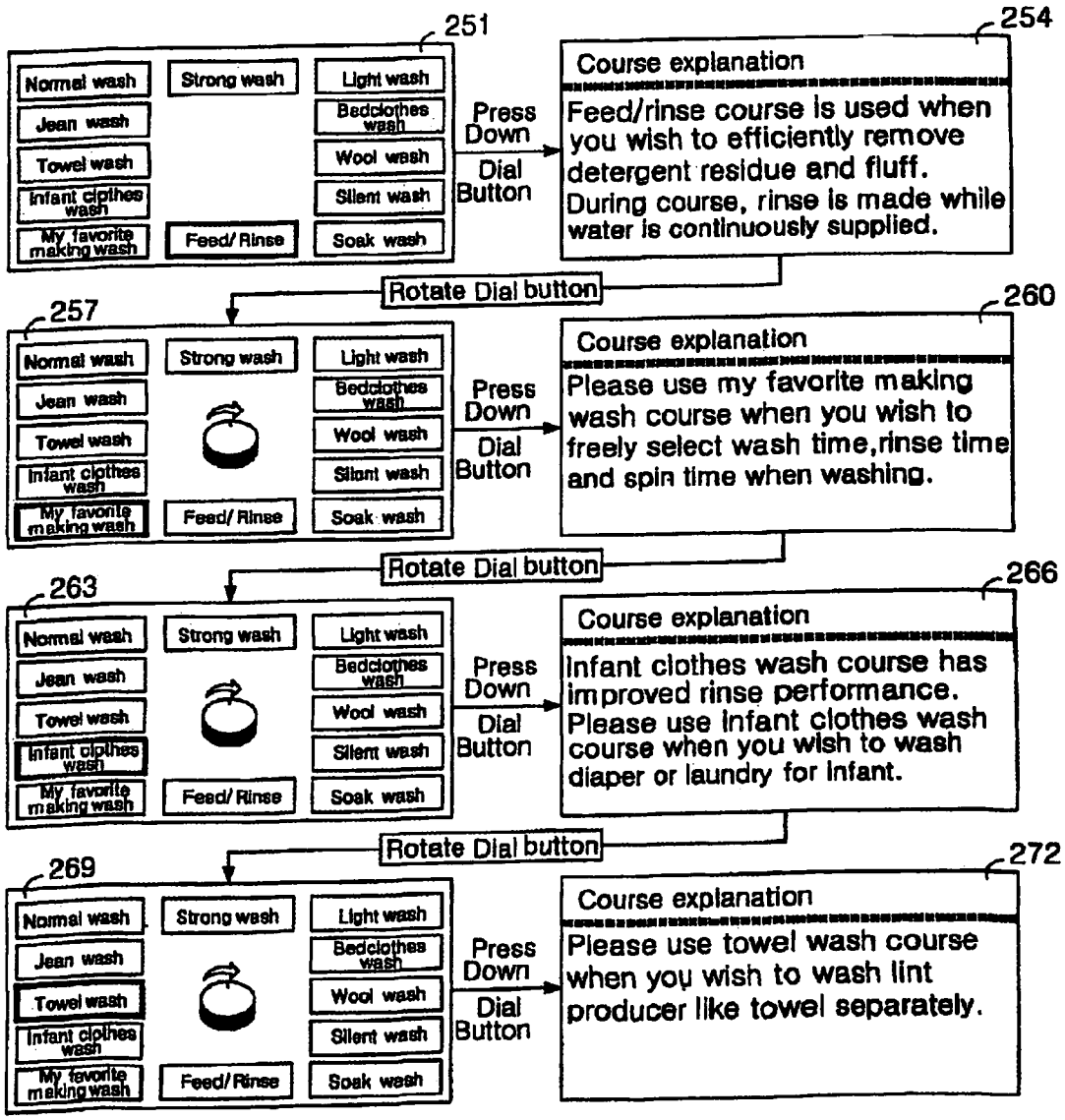
Figure 4D:
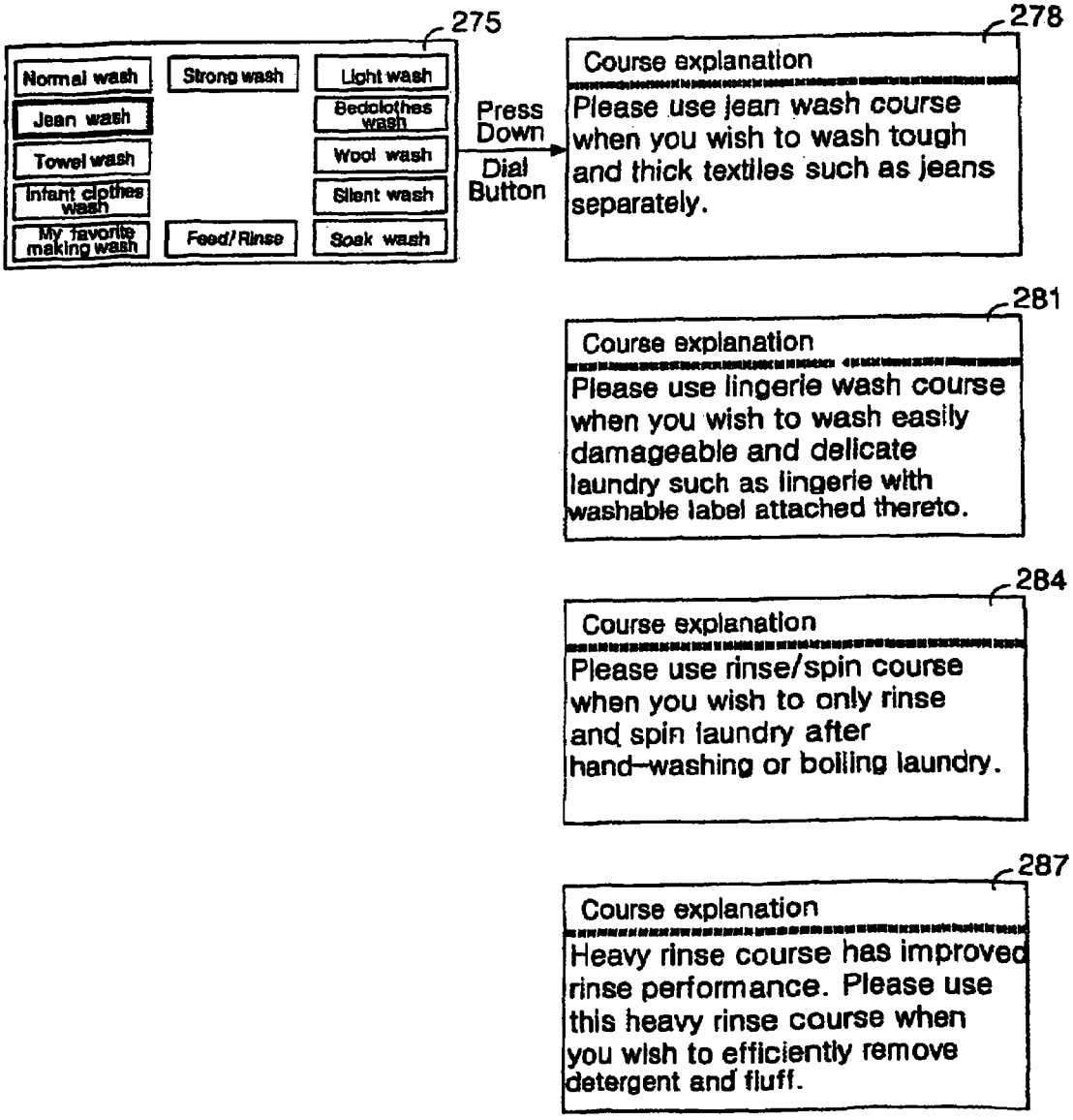

The wash help of the present invention causes higher-level menus in the wash help shown in FIG. 3 to be sequentially displayed onto the LCD display unit 40 whenever the user selects the "help button" in the signal input unit 10. The screens displayed at this time correspond to steps 200 and 203 of FIG. 4*a*. That is, the screen of step 200 of FIG. 4*a* becomes a state of the initial menu of the wash help, and the screen of step 203 is displayed by rotating the dial button in order to view the next menu.

Next, FIGS. 4*a* to 4*d* sequentially show the usage guidelines corresponding to the "course explanation" menu of the wash help according to the present invention.

First, the user rotates the dial button to place the cursor (inverse image) onto the "course explanation" menu in a state where the initial menu of the wash help of step 200 is displayed onto the LCD display unit 40. Then, the user presses down the dial button and selects the "course explanation" menu. After the "course explanation" menu has been selected, the microcontroller 20 reads the usage guidelines of the "course explanation" menu from the memory 30. Thereafter, the read usage guidelines are displayed onto the LCD display unit 40. The displayed screen corresponds to step 206 of FIG. 4*a*.

Further, the user selects a desired course as instructed in step 206 and performs the operation of retrieving the usage guidelines related thereto. That is, the user rotates the dial button to place the cursor (inverse image) onto the desired course (normal wash) item (step 209), and presses down the dial button to select the "normal wash" menu. If the "normal wash" menu is selected, the microcontroller 20 reads the usage guidelines of the "normal wash" menu from the memory 30. Then, the read usage guidelines are displayed onto the LCD display unit 40. The displayed screen corresponds to step 212 of FIG. 4*a*.

If the course item which the user wishes to obtain is not the "normal wash" menu but a "strong wash" menu, the user further rotates the dial button to place the cursor (inverse image) onto the "strong wash" menu (step 215). Then, the user presses down the dial button to select the "strong wash" menu. If the "strong wash" menu is selected, the microcontroller 20 reads the usage guidelines of the "strong wash" menu from the memory 30. Then, the read usage guidelines are displayed onto the LCD display unit 40. The displayed screen corresponds to step 218 of FIG. 4*a*.

By repeating the above processes, all the usage guidelines of courses such as a light wash, a bedclothes wash, a wool wash, a silent wash, a soak wash, a feed and rinse, a my favorite making wash, an infant clothes wash, a towel wash, and a jean wash, which have been included in the "course explanation" menu can be selectively displayed (steps 221 to 278).

The other "course explanation" menus may be further added. That is, a lingerie wash course in step 281, a rinse/spin course in step 284, a heavy rinse course in step 287, and the like are selectively displayed. In other words, FIGS. 4*a* to 4*d* show the processes of explaining the features of various courses provided in the washing machine, washable clothes, and the like.

Therefore, after the usage guidelines of the desired courses provided in the "course explanation" menu of the wash help have been displayed and provided to the user, the user should cause the wash help to go out from the "course explanation" menu thereof. That is, the wash help goes into the initial menu thereof so that the user views the usage guidelines corresponding to the next item, or it goes into the initial menu of the washing course so that the user performs the washing process.

The user presses down the help button in order to cause the wash help to go into the initial menu thereof from the "course explanation" menu of the wash help. Thus, the initial menu of the wash help is displayed onto the LCD display unit 40. Further, the user presses down the return button in order to cause the wash help to be changed from the "course explanation" menu of the wash help into the initial menu of the washing course for performing the washing process. Thus, the wash help comes to an end; and the standby state for the washing, i.e. the initial menu of the washing course is displayed.

Figure 5A:
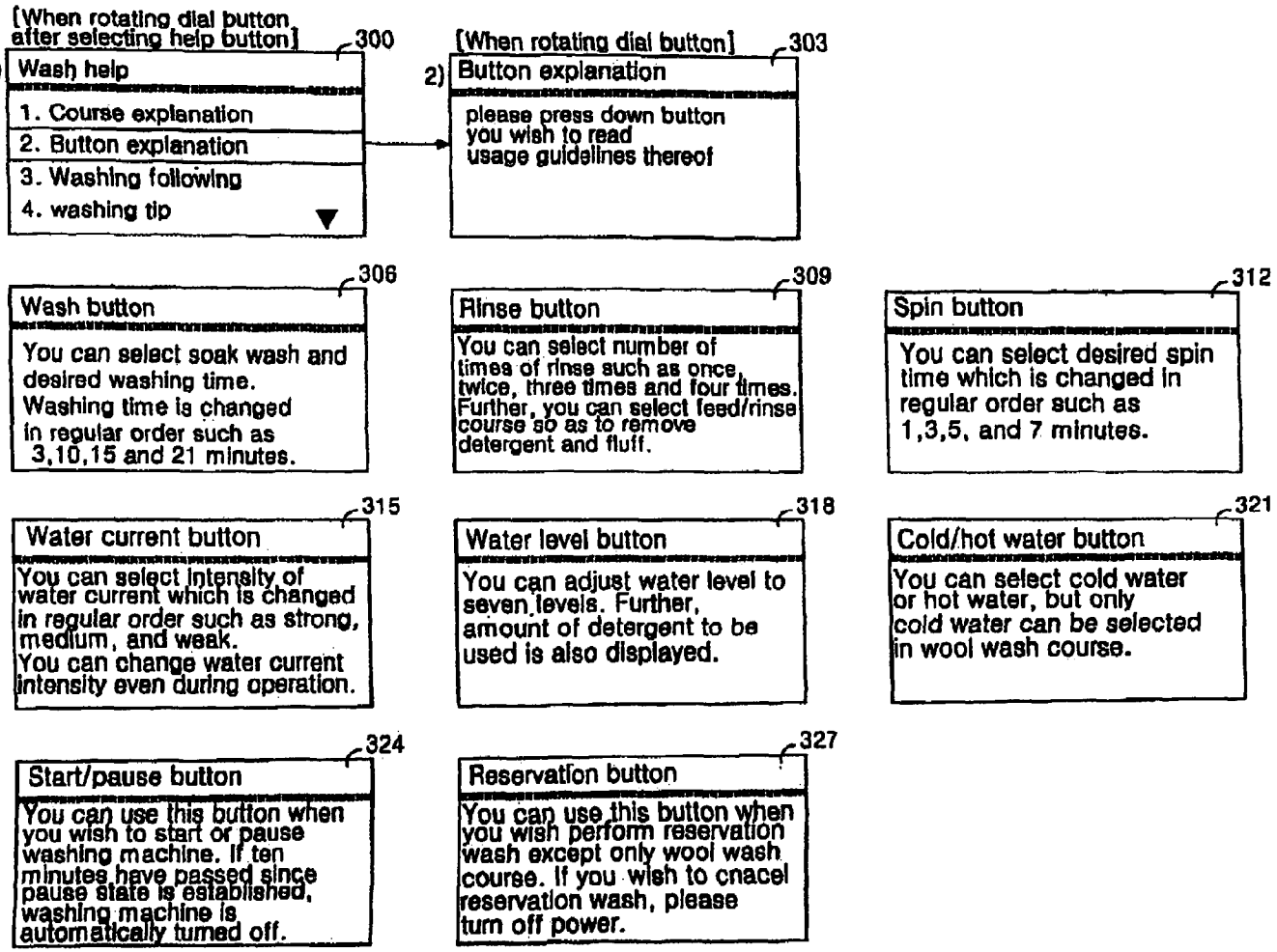
Figure 6:
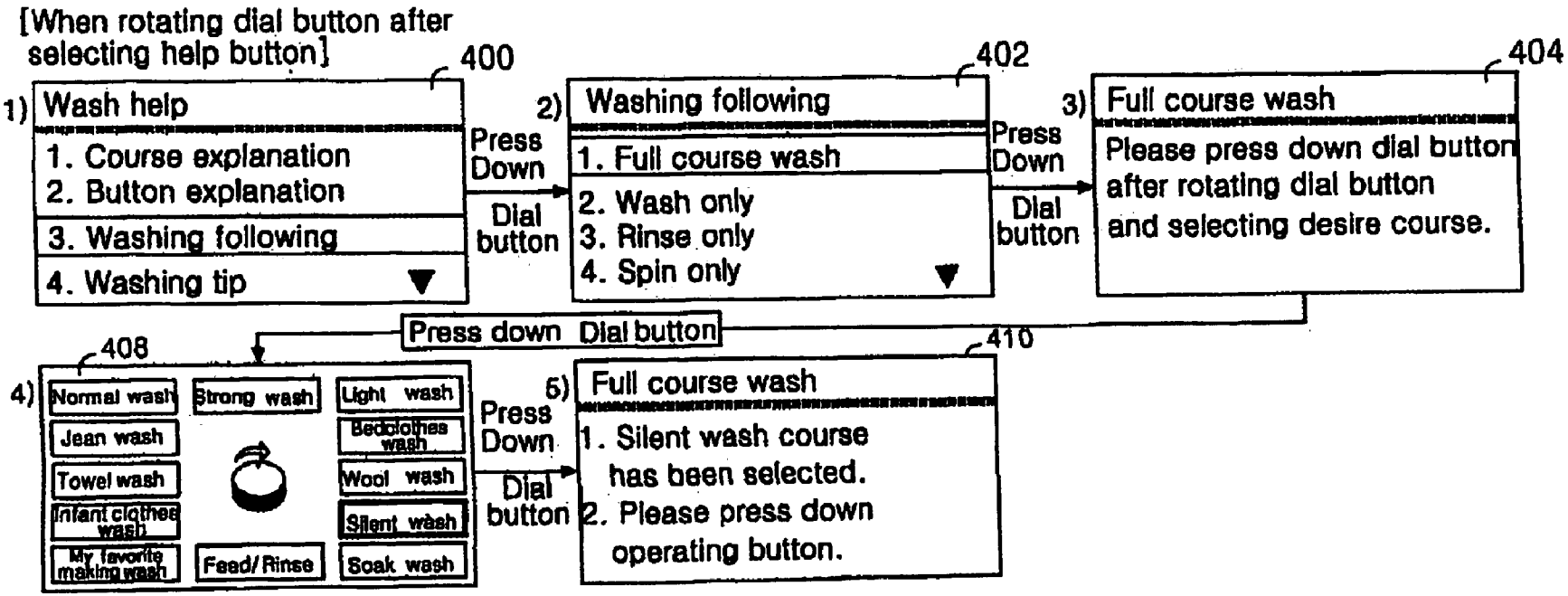
FIGS. 6 to 13 are operating flowcharts for sequentially illustrating usage guidelines corresponding to a "washing following" menu of the wash help of the present invention.
Figure 7:
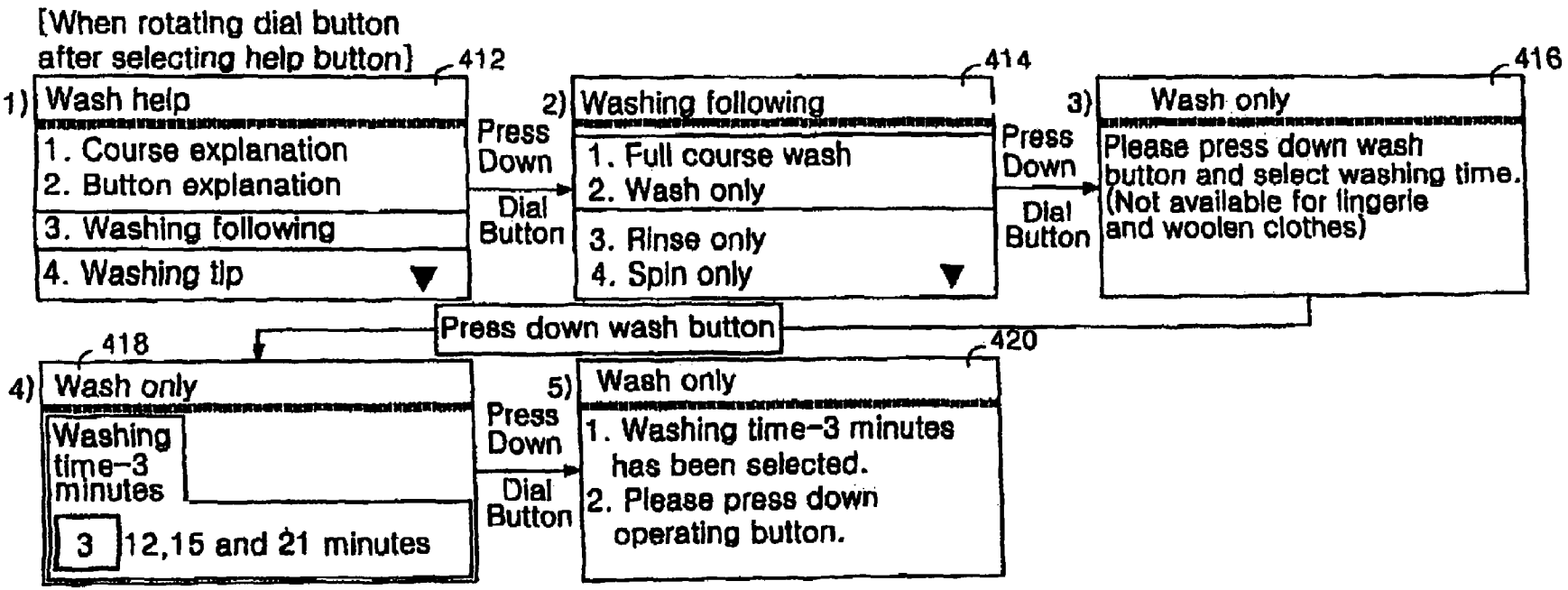

Next, FIGS. 5*a* and 5*b* sequentially show the usage guidelines corresponding to the "button explanation" menu of the wash help according to the present invention.

If the user intends to view the usage guidelines corresponding to the "button explanation" menu of the wash help while the wash help is currently operated, the user presses down the help button once again to cause the initial menu of the wash help (step 300) to be displayed. Further, if the user wishes to view the usage guidelines corresponding to the "button explanation" menu of the wash help during the washing, the user consecutively presses down the start/pause button and the help button to pause the washing process. Then, the initial menu of the wash help (step 300) is displayed.

The user rotates the dial button to place the cursor (inverse image) onto the "button explanation" menu in a state where the initial menu of the wash help of step 300 is displayed onto the LCD display unit 40. Then, the user presses down the dial button and selects the "button explanation" menu. After the "button explanation" menu has been selected, the microcontroller 20 reads the usage guidelines of the "button explanation" menu from the memory 30. Thereafter, the read usage guidelines are displayed onto the LCD display unit 40. The displayed screen corresponds to step 303 of FIG. 5*a*.

Further, the user presses down a relevant button as instructed in step 303 and performs the operation of retrieving the usage guidelines related thereto.

The usage guidelines, which are displayed onto the LCD display unit 40 when the user presses down the wash button, are shown in step 306. Likewise, the usage guidelines are also displayed onto the LCD display unit 40 by the microcontroller 20 after the microcontroller 20 recognizes that the user wishes to view the usage guidelines corresponding to the "wash button" and then retrieves the usage guidelines from the memory 30.

The usage guidelines, which are displayed onto the LCD display unit 40 when the user presses down the rinse button, are shown in step 309. Likewise, the usage guidelines are also displayed onto the LCD display unit 40 by the microcontroller 20 after the microcontroller 20 recognizes that the user wishes to view the usage guidelines corresponding to the "rinse button" and then retrieves the usage guidelines from the memory 30.

By repeating the above processes, the usage guidelines corresponding to the buttons such as spin button, water current button, water level button, hot/cold water button, start/pause button, reservation button, help button, my favorite making button, and return button 16 can be selectively retrieved from the memory 30 and displayed onto the LCD display unit 40 while the "button explanation" menu of the wash help is operated (steps 312 to 336).

That is, FIGS. 5*a* and 5*b* show the processes of explaining functions of the respective buttons provided in the washing machine.

Next, FIGS. 6 to 13 sequentially show the usage guidelines corresponding to the "washing following" menu of the wash help according to the present invention.

If the user intends to view the usage guidelines corresponding to the "washing following" menu of the wash help or to perform the washing in accordance with the instructions of the "washing following" menu while the wash help is currently operated, the user presses down the help button once again to cause the initial menu of the wash help (step 400) to be displayed. Further, if the user wishes to view the usage guidelines corresponding to the "washing following" menu of the wash help during the washing, the user consecutively presses down the start/pause button and the help button to pause the washing process. Then, the initial menu of the wash help (step 400) is displayed.

The user rotates the dial button to place the cursor (inverse image) onto the "washing following" menu in a state where the initial menu of the wash help of step 400 is displayed onto the LCD display unit 40. Then, the user presses down the dial button to select the "washing following" menu. After the "washing following" menu has been selected, the microcontroller 20 causes lower-level menus of the "washing following" menu to be displayed onto the LCD display unit 40 (step 402).

As shown in FIG. 3, the "washing following" menu is subdivided into a full course wash, a wash only, a rinse only, a spin only, a rinse/spin, a reservation wash, a soak wash, and a feed/rinse.

Thus, the user rotates the dial button to place the cursor (inverse image) onto a desired item among the lower-level menus of the "washing following" menu shown in step 402, and then presses down the dial button to select the desired item.

If the "full course wash" is selected as a first item of the "washing following" menu, the microcontroller 20 retrieves the usage guidelines of the "full course wash" from the memory 30. Thereafter, the retrieved usage guidelines are displayed onto the LCD display unit 40. The displayed screen corresponds to step 404 of FIG. 6*a*.

Next, the user rotates the dial button and selects a desired course item, as instructed in step 404. That is, when the dial button is rotated, the contents of step 408 corresponding to the initial menu of the washing course are displayed onto the LCD display unit. The user rotates the dial button to place the cursor (inverse image) onto the desired course item (silent wash), and presses down the dial button to select the "silent wash" course item.

If the "silent wash" course in the "full course wash" is selected at step 408, the microcontroller 20 recognizes that the "washing following"—the "full course wash"—the "silent wash" course has been selected, and retrieves the usage guidelines related thereto so that the retrieved usage guidelines are displayed onto the LCD display unit 40. The usage guidelines displayed as such are shown in step 410.

Thereafter, the user presses down the operating button for performing the "silent wash" in accordance with the usage guidelines displayed onto the LCD display unit 40 at step 410.

If the course the user wishes to perform is not the "washing following"—the "full course wash"—the "silent wash" course although the above processes have already proceeded, the user should select the help button. The selection of the help button allows the wash help to go into the initial menu screen thereof regardless of any location of the wash help. Thus, the microcontroller 20 causes the wash help to go into the initial menu thereof which is in turn displayed onto the LCD display unit 40. The displayed screen corresponds to step 412.

In step 412, the user selects the "washing following" menu from the initial menu of the wash help by using the dial button. In step 414, the user further selects the "wash only" among the subdivided items of the "washing following" menu by using the dial button.

If the "washing following"—the "wash only" course is selected at step 414, the microcontroller 20 retrieves the usage guidelines of the "wash only" from the memory 30, and causes the usage guidelines to be displayed onto the LCD display unit 40. The displayed screen corresponds to step 416.

Thereafter, the user presses down the operating button for performing the "wash only" in accordance with the usage guidelines displayed at step 416. Then, the user selects a washing time and presses down the operating button to perform the "washing following"—the "wash only" course (steps 418 and 420).

Figure 8:
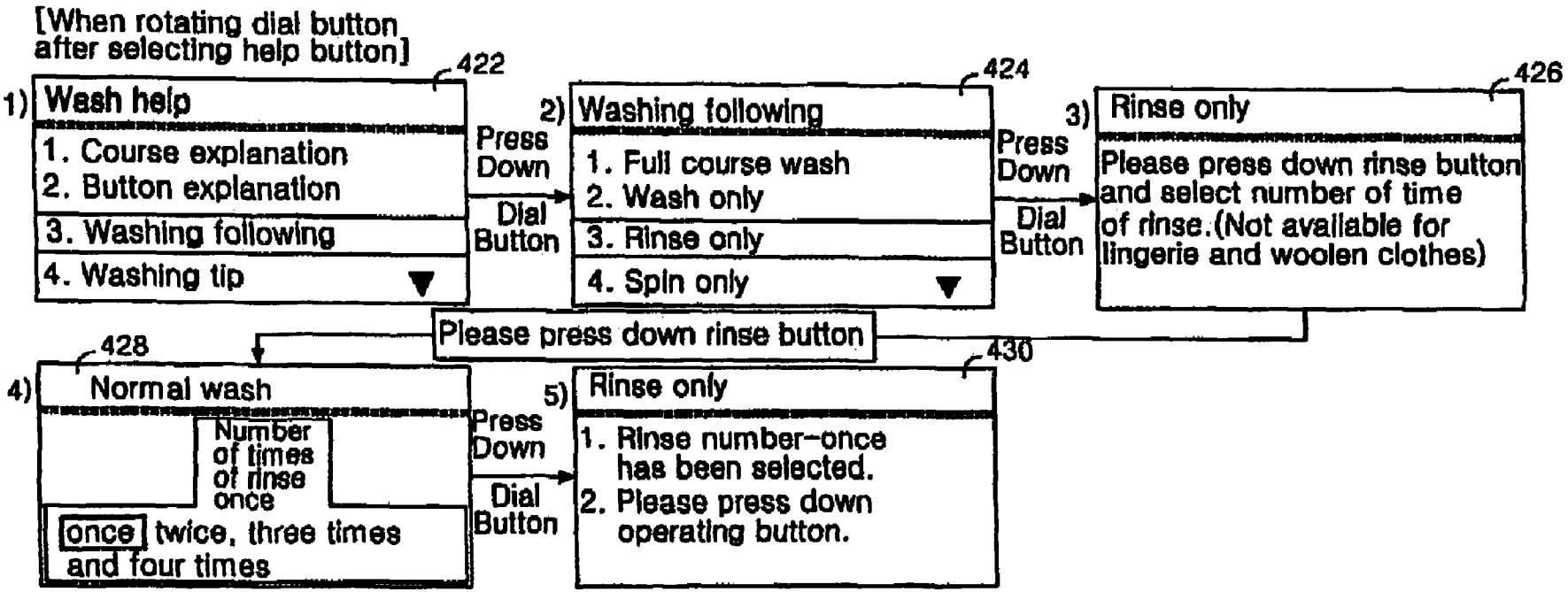

FIG. 8 shows a process of the "rinse only" in the "washing following" menu.

That is, the initial menu of the wash help is displayed by selecting the help button (step 422), and the "rinse only" menu in the "washing following" menu is selected by rotating and pressing down the dial button (step 424).

If the "rinse only" is selected at step 424, the microcontroller 20 retrieves the usage guidelines corresponding to the "rinse only" course from the memory 30 and causes the usage guidelines to be displayed onto the LCD display unit 40. The retrieved usage guidelines are shown in step 426.

Thereafter, the user selects the rinse button in accordance with the usage guidelines displayed at step 426, selects the number of times of rinse, and presses down an operating button for performing the "rinse only" course. Thus, the operation of the "rinse only" course starts (steps 428 and 430).

Figure 9:
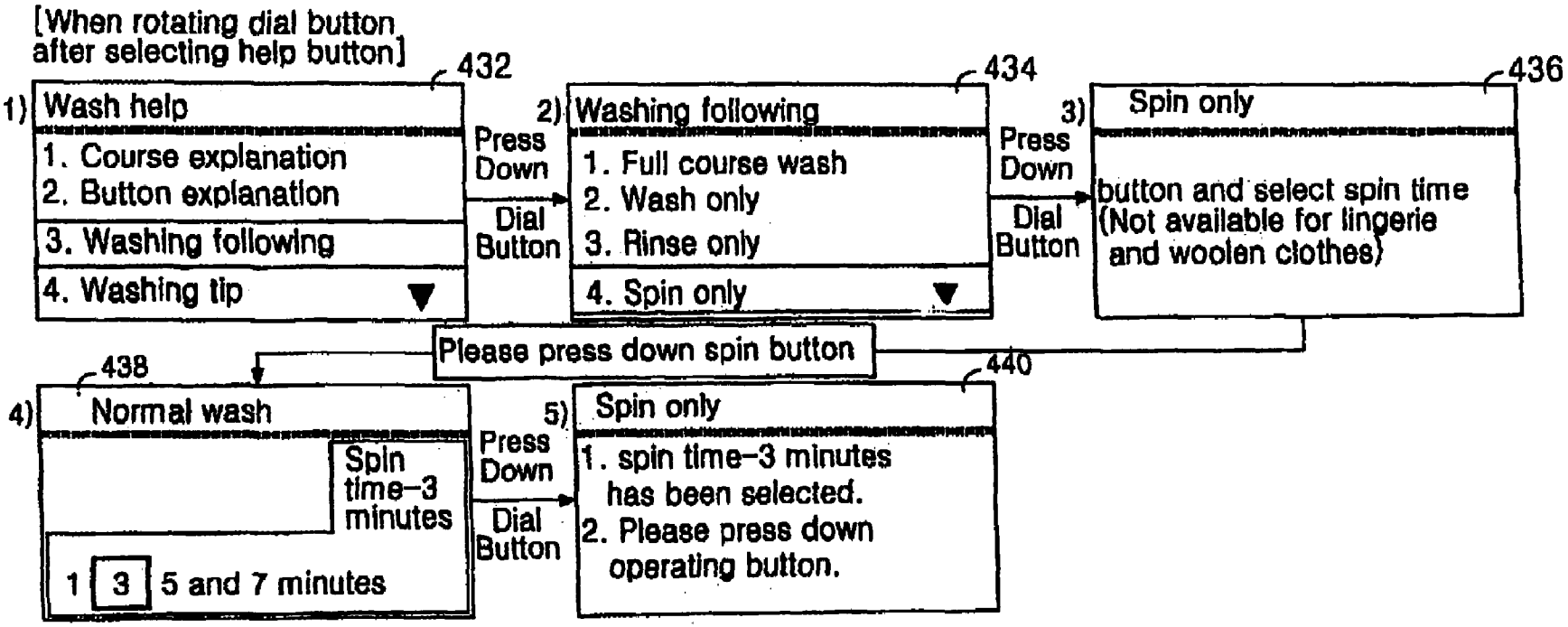

FIG. 9 shows a process of the "spin only" in the "washing following" menu.

That is, the initial menu of the wash help is displayed by selecting the help button (step 432), and the "spin only" in the "washing following" menu is selected by rotating and pressing down the dial button (step 434).

If the "spin only" is selected at step 434, the microcontroller 20 retrieves the usage guidelines corresponding to the "spin only" course from the memory 30 and causes the usage guidelines to be displayed onto the LCD display unit 40. The retrieved usage guidelines are shown in step 436.

Thereafter, the user selects the spin button in accordance with the usage guidelines displayed at step 436, selects the spin time, and presses down an operating button for performing the "spin only" course. Thus, the operation of the "spin only" course starts (steps 438 and 440).

Figure 10:
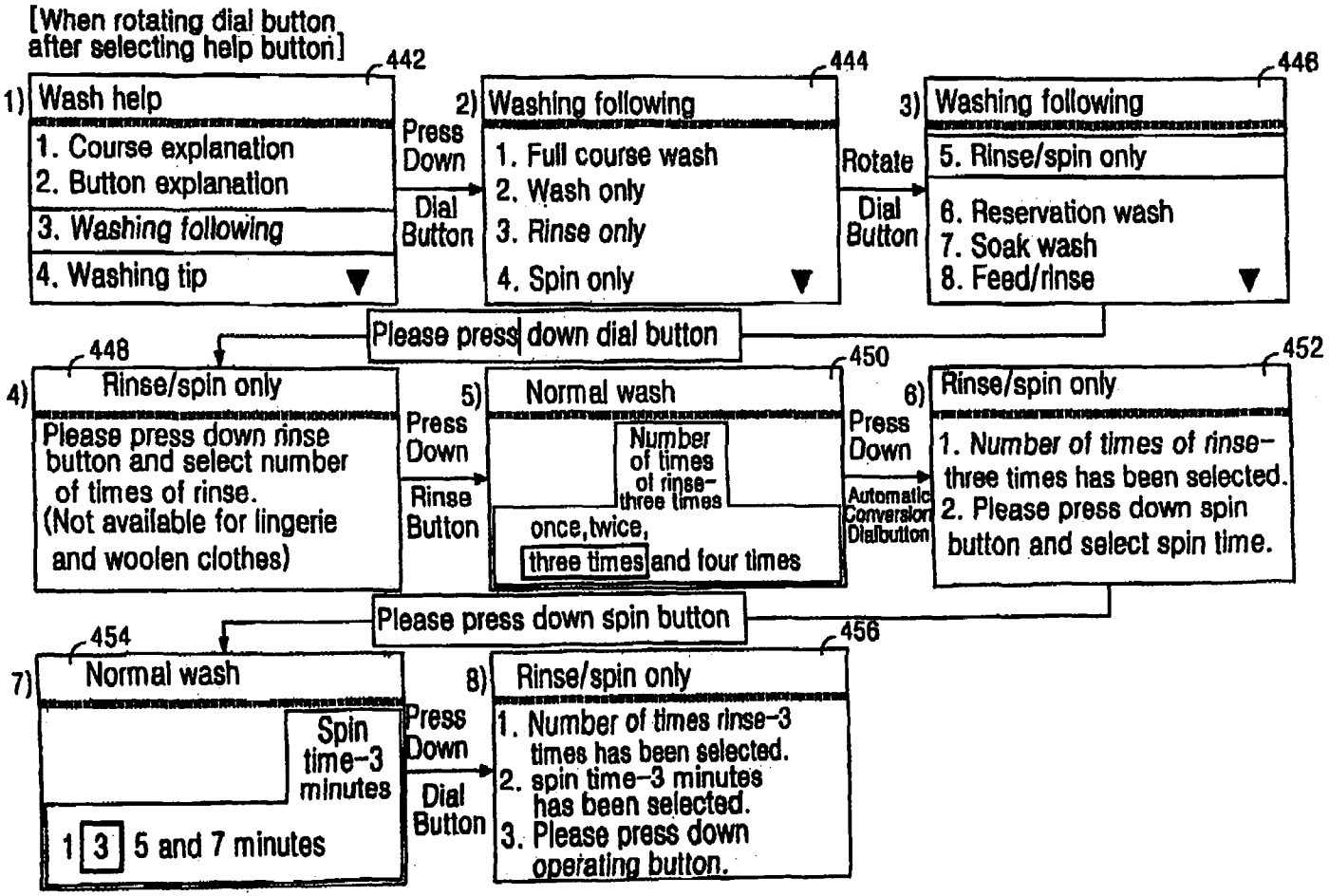

FIG. 10 shows a process of the "rinse/spin only" in the "washing following" menu.

That is, the initial menu of the wash help is displayed by selecting the help button (step 442), and the "rinse/spin only" in the "washing following" menu is selected by rotating and pressing down the dial button (steps 444 and 446).

If the "rinse/spin only" is selected at step 446, the microcontroller 20 retrieves the usage guidelines corresponding to the "rinse/spin only" course from the memory 30 and causes the usage guidelines to be displayed onto the LCD display unit 40. The retrieved usage guidelines are shown in step 448.

Thereafter, the user selects the rinse button in accordance with the usage guidelines displayed at step 448 and selects the number of times of rinse (step 450). If the user selects the number of times of rinse at step 450, a message for confirming the selected number of times of rinse and the instructions for the next operation are displayed onto the LCD display unit 40 (step 452).

Further, if the user presses down the spin button and selects the spin time in accordance with the usage guidelines displayed at step 452 (step 454), the usage guidelines for confirming the number of times of rinse and the spin time the user selected and informing that the "rinse/spin only" operation will start when pressing down the operating button are displayed onto the LCD display unit 40 (step 456).

Figure 11:
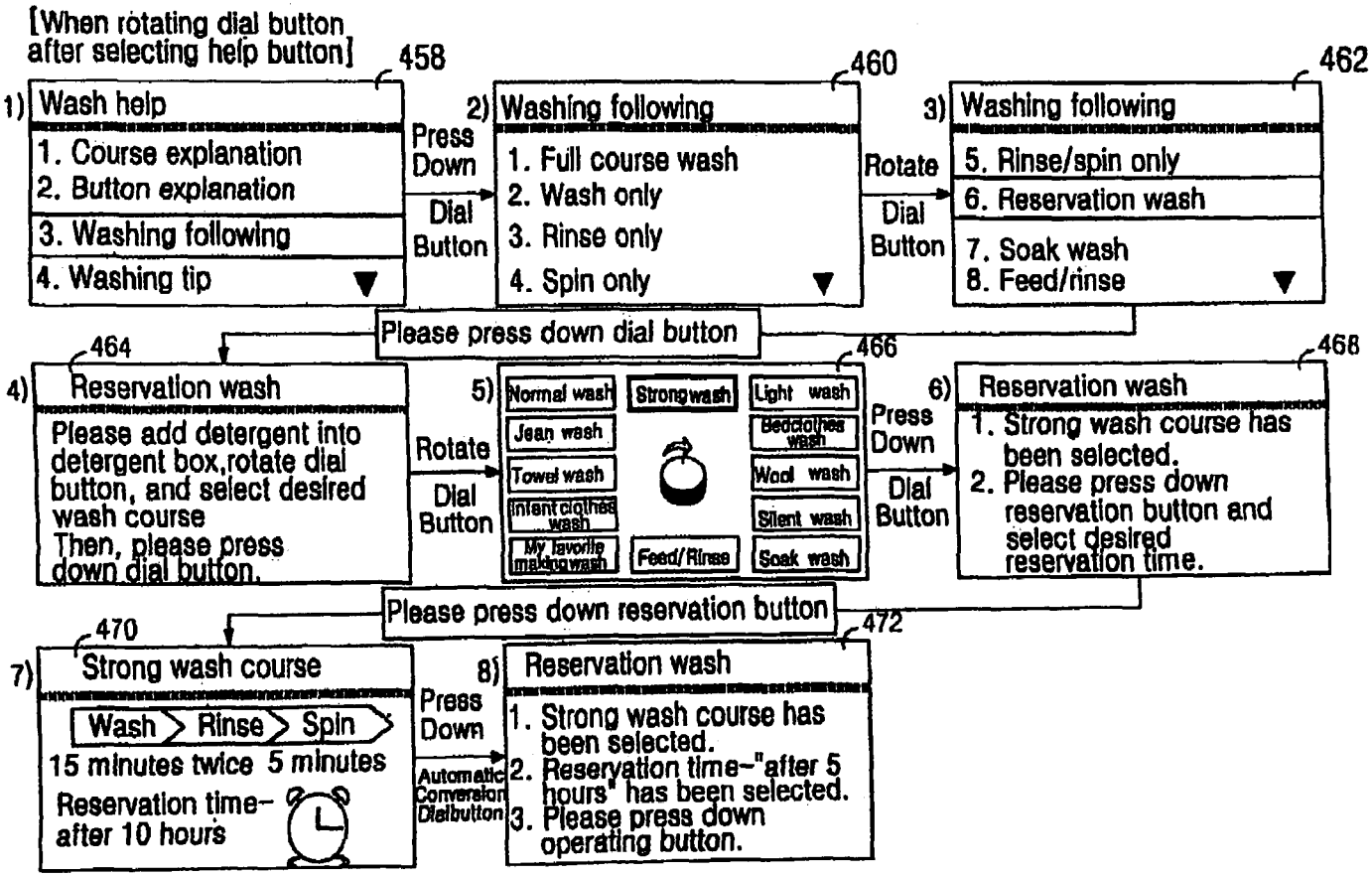

FIG. 11 shows a process of the "reservation wash" in the "washing following" menu.

That is, the initial menu of the wash help is displayed by selecting the help button (step 458), and the "reservation wash" in the "washing following" menu is selected by rotating and pressing down the dial button (steps 460 and 462).

If the "reservation wash" is selected at step 462, the microcontroller 20 retrieves the usage guidelines corresponding to the "reservation wash" course from the memory 30 and causes the usage guidelines to be displayed onto the LCD display unit 40. The retrieved usage guidelines are shown in step 464.

Thereafter, the user selects a course the user wishes to perform the "reservation wash" course in accordance with the usage guidelines displayed at step 464 (step 466). If the desired course is selected at step 466, a message for confirming the selected course and the instructions for the next operation are displayed onto the LCD display unit 40 (step 468).

Thereafter, if the user presses down the reservation button and selects the reservation time in accordance with the usage guidelines displayed at step 468, the usage guidelines corresponding to the reservation course and time selected by the user are displayed (step 470). Further, the usage guidelines for confirming the selected contents and informing that the "reservation wash" operation will start when pressing down the operating button are displayed onto the LCD display unit 40 (step 472).

Figure 12:
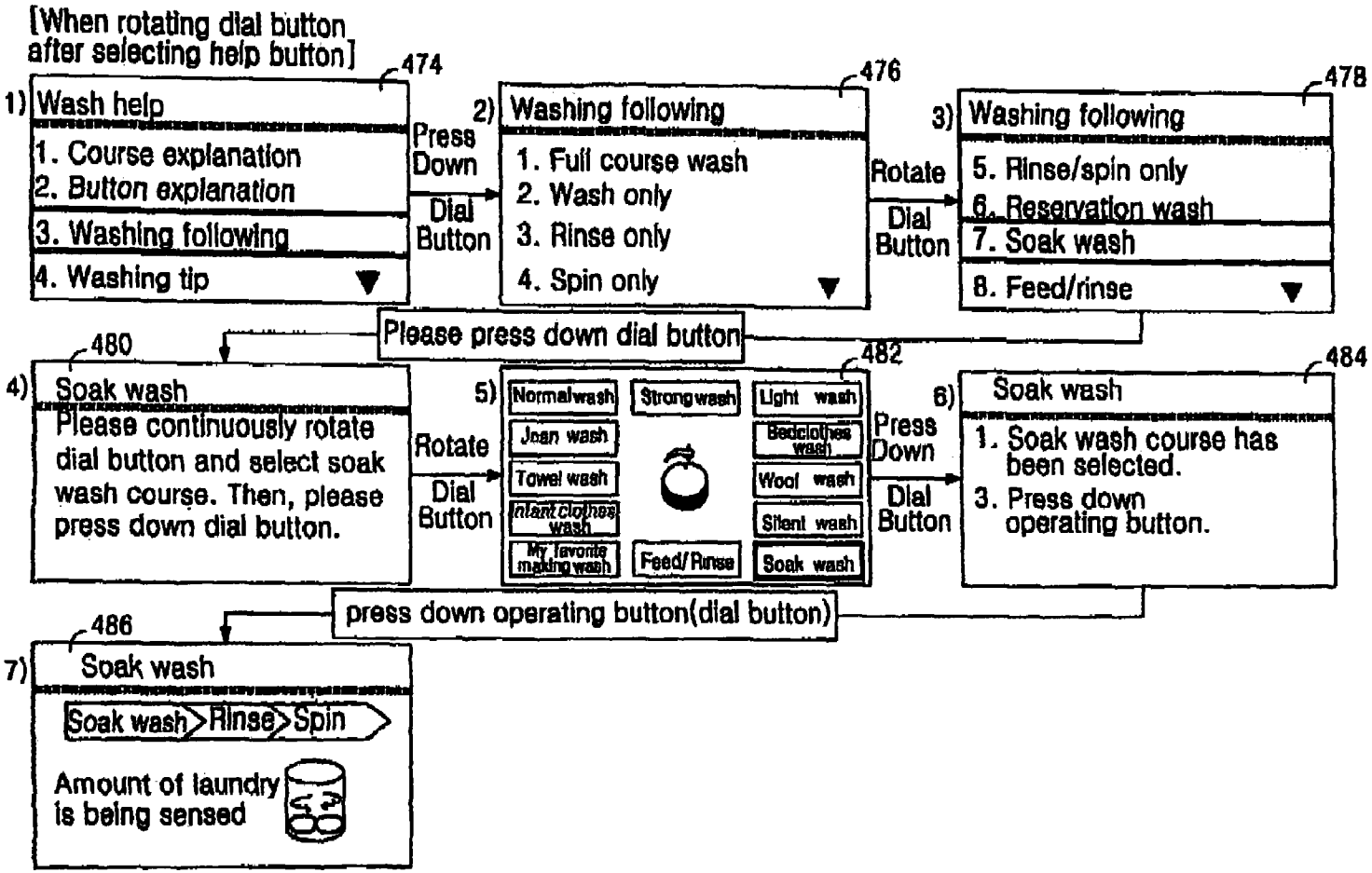

FIG. 12 shows a process of the "soak wash" in the "washing following" menu.

That is, the initial menu of the wash help is displayed by selecting the help button (step 474), and the "soak wash" in the "washing following" menu is selected by rotating and pressing down the dial button (steps 476 and 478).

If the "soak wash" is selected at step 478, the microcontroller 20 retrieves the usage guidelines and instructions corresponding to the "soak wash" course from the memory 30 and causes the guidelines and instructions to be displayed onto the LCD display unit 40. The retrieved usage guidelines and instructions are shown in step 480.

Thereafter, the user selects the "soak wash" course the user wishes to make in accordance with the usage guidelines and instructions displayed at step 480 (step 482). If the desired course is selected at step 482, a message for confirming the selected course and the instructions for the next operation are displayed onto the LCD display unit 40 (step 484). Then, the operation of the "soak wash" will start when pressing down the operating button (step 486).

Figure 13:
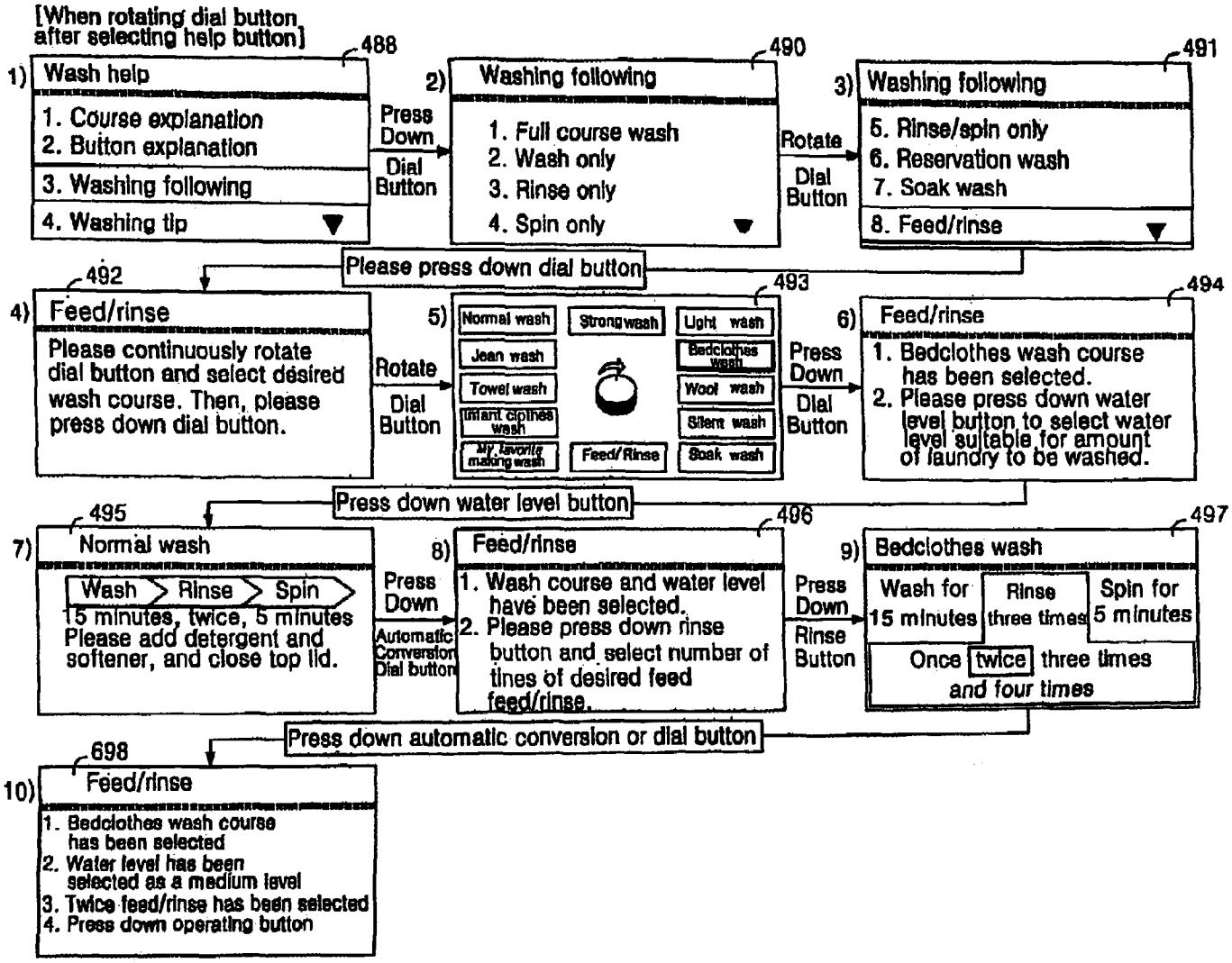

FIG. 13 shows a process of the "feed/rinse wash" in the "washing following" menu.

That is, the initial menu of the wash help is displayed by selecting the help button (step 488), and the "feed/rinse wash" in the "washing following" menu is selected by rotating and pressing down the dial button (steps 490 and 491).

If the "feed/rinse wash" is selected at step 491, the microcontroller 20 retrieves the usage guidelines and instructions corresponding to the "feed/rinse wash" course from the memory 30 and causes the guidelines and instructions to be displayed onto the LCD display unit 40. The retrieved usage guidelines and instructions are shown in step 492.

Thereafter, the user selects the "feed/rinse wash" course the user wishes to make in accordance with the usage guidelines and instructions displayed at step 492 (step 493). If the "bedclothes wash" course is selected as shown in step 493, a message for confirming the selected course and the instructions for the next operation are displayed onto the LCD display unit 40 (step 494).

In step 494, it is instructed that the water level should be selected by pressing down the water level button. Thus, the user selects the water level in step 495, and a message for confirming the selected course and water level and the instructions for the next operation are displayed in step 496.

If the number of times of feed/rinse is selected in accordance with the instructions in step 496 (step 497), the usage guidelines for confirming the selected contents of the "feed/rinse" course and informing that the "feed/rinse" operation will start when pressing down the operating button are finally displayed onto the LCD display unit 40 in step 498.

That is, the processes shown in FIGS. 6 to 13 are processes which are operated according to the "washing following" menu of the wash help. In other words, the processes correspond to guides which inform the inexperienced person, who does not well know usage of the washing machine, of the usage and instructions by the respective stages so that actual washing processes can be performed when the inexperienced person operate the washing machine according to the informed instructions.

Next, FIGS. 14 to 17 show the processes of providing the user with various kinds of information on the "washing tip" menu in the wash help.

Figure 14:
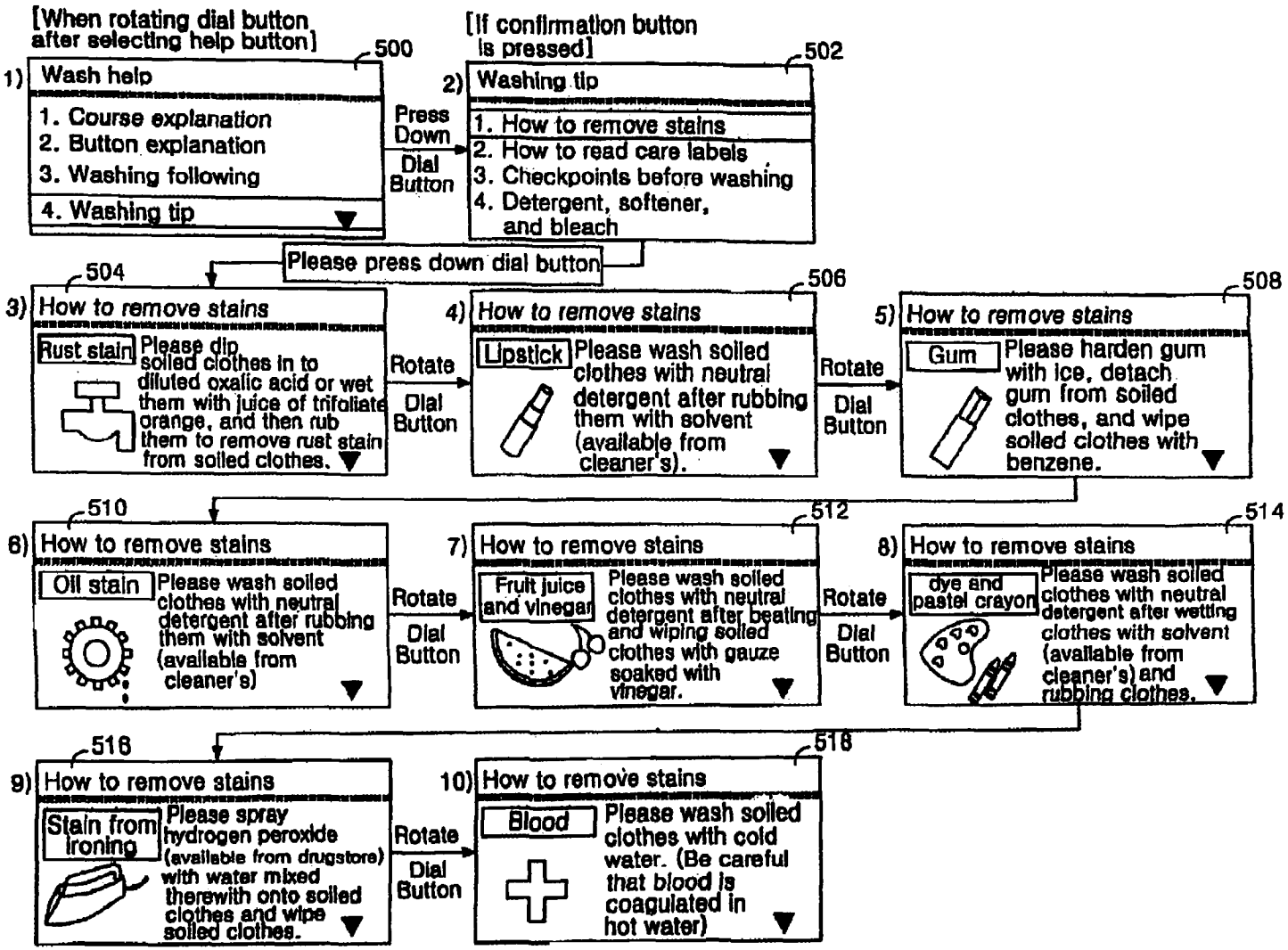
FIGS. 14 to 17 are procedural views illustrating how to provide various kinds of information on a "washing tip" menu of the wash help according to the present invention.

FIG. 14 is a procedural view for illustrating a "method for removing stains" menu corresponding to a lower-level menu of the "washing tip" menu in the wash help.

First, if the user selects the help button in the signal input unit 10, the initial menu of the wash help is displayed (step 500). When the initial menu shown in step 500 is displayed, the user rotates the dial button to place the cursor (inverse image) onto the "washing tip" menu and presses down the dial button to select the "washing tip" menu.

If the "washing tip" menu of the wash help is selected, the lower-level menus of the "washing tip" menu are displayed onto the LCD display unit 40 (step 502). Thus, step 504 corresponds to a case where the "how to remove stains" menu corresponding to a first menu among the lower-level menus of the "washing tip" menu is selected.

That is, the "how to remove stains" menu describes how to remove the stains according to the stain categories. Thus, the user rotates the dial button until usage guidelines for the stains which the user wishes to remove are displayed onto the LCD display unit 40. According to the user's rotation of the dial button, the microcontroller 20 retrieves the usage guidelines of the "how to remove stains" menu stored in the memory 30, and displays them onto the LCD display unit 40. Thus, in steps 504 to 518, the stain categories and methods of removing the respective stains, which are provided in the washing machine of the present invention, are explained to the user.

Figure 15:
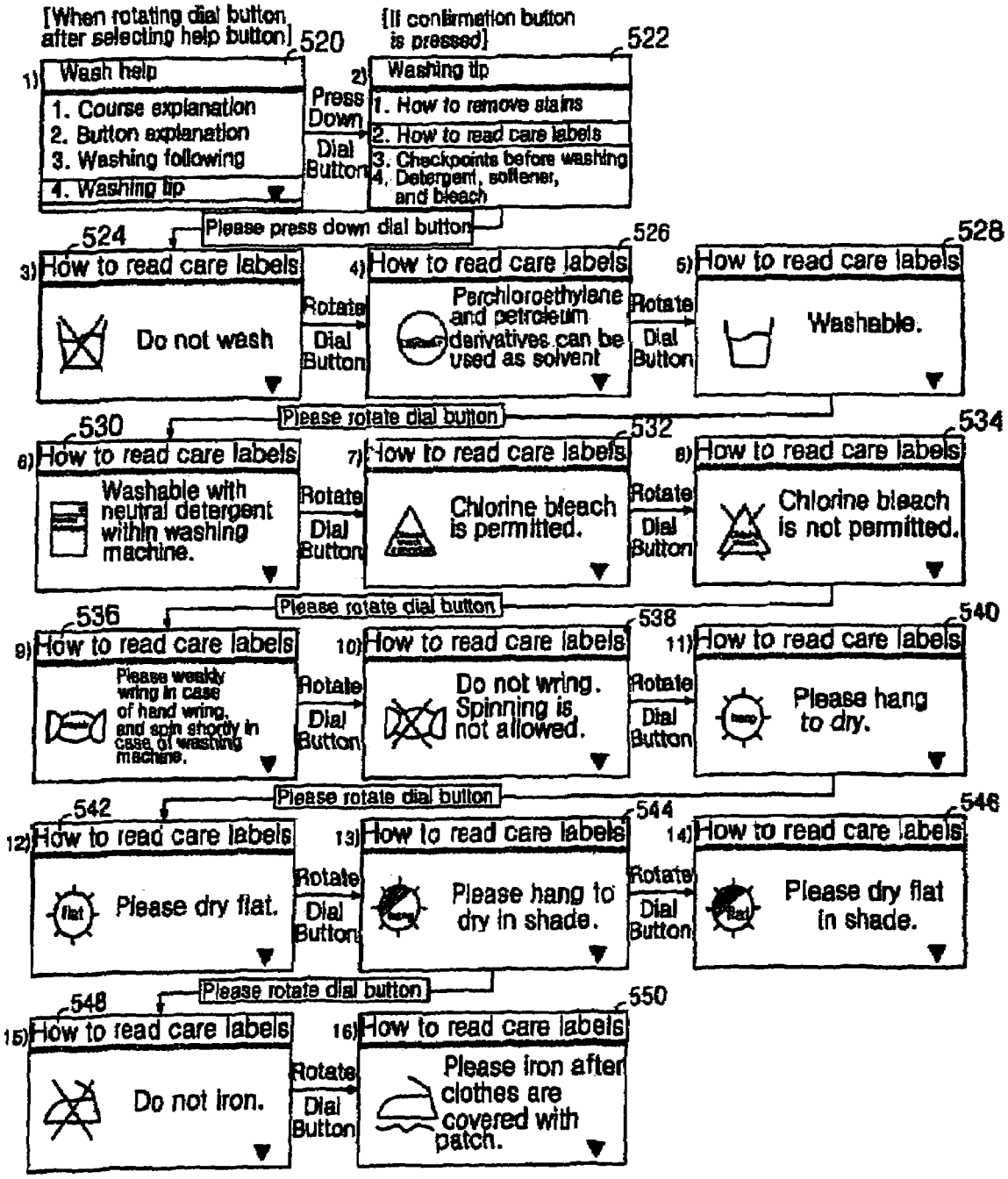

FIG. 15 is a procedural view for illustrating a "how to read care labels" menu corresponding to another lower-level menu of the "washing tip" menu in the wash help.

If the user selects the help button in the signal input unit 10, the initial menu of the wash help is displayed (step 520). When the initial menu shown in FIG. 520 is displayed, the user rotates the dial button to place the cursor (inverse image) onto the "washing tip" menu and presses down the dial button to select the "washing tip" menu.

If the "washing tip" menu of the wash help is selected, the lower-level menus of the "washing tip" menu are displayed onto the LCD display unit 40 (step 522). Thus, step 524 corresponds to a case where the "how to read care labels" menu corresponding to a second menu among the lower-level menus of the "washing tip" menu is selected.

That is, the "how to read care labels" menu illustrates fabric care labels. Thus, the user rotates the dial button until usage guidelines for a fabric care label which the user wishes to read are displayed onto the LCD display unit 40. According to the user's rotation of the dial button, the microcontroller 20 retrieves the usage guidelines of the "how to read care labels" menu stored in the memory 30, and displays them onto the LCD display unit 40. Thus, in steps 524 to 550, the fabric care labels provided in the washing machine of the present invention are explained to the user. These fabric care labels are sequentially displayed onto the LCD display unit 40 in accordance with the rotation of the dial button.

Figure 16:
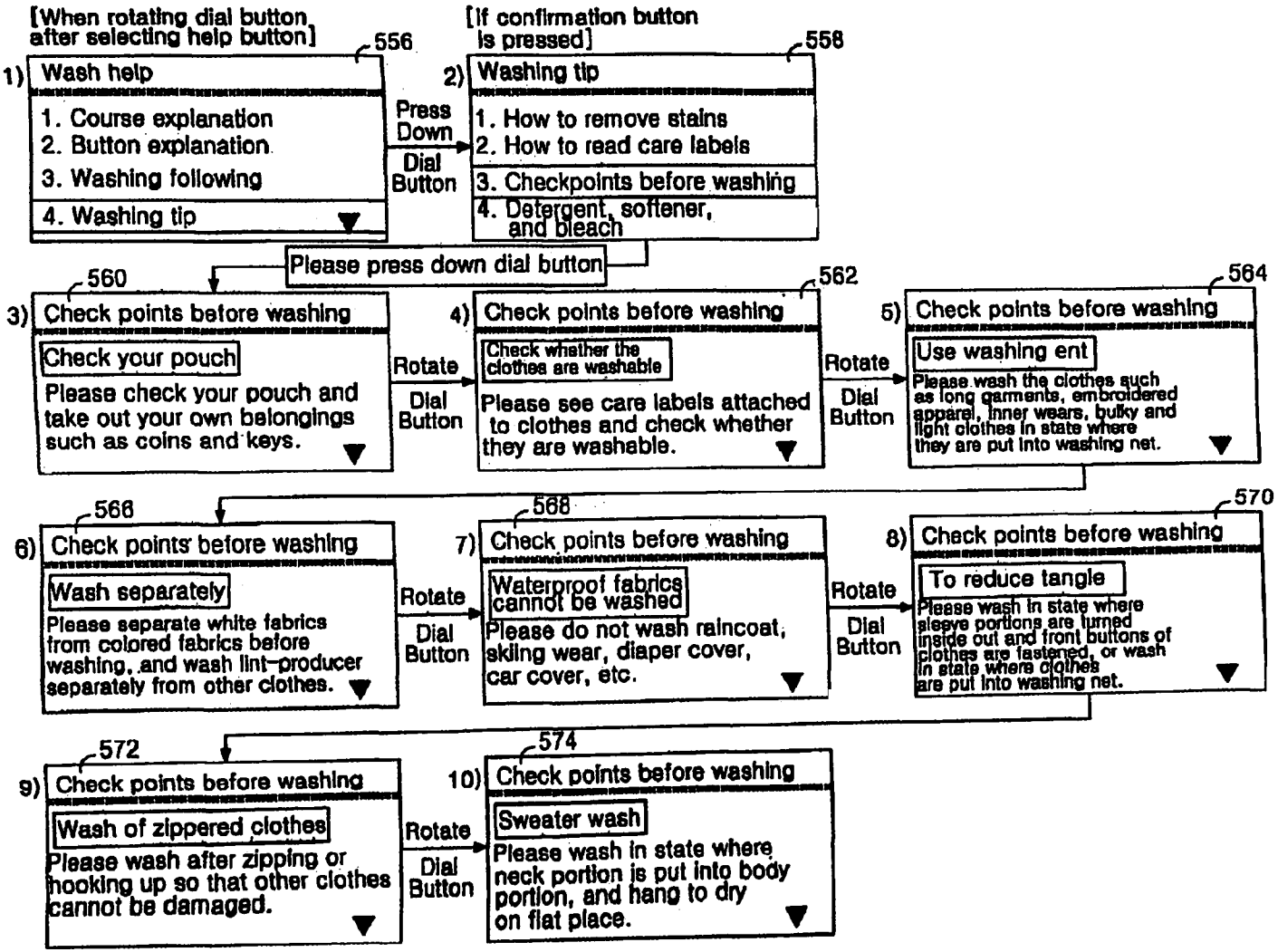

FIG. 16 is a procedural view for illustrating a "checkpoint before washing" menu corresponding to a further lower-level menu of the "washing tip" menu in the wash help.

If the user selects the help button in the signal input unit 10, the initial menu of the wash help is displayed (step 556). When the initial menu shown in FIG. 556 is displayed, the user rotates the dial button to place the cursor (inverse image) onto the "washing tip" menu and presses down the dial button to select the "washing tip" menu.

If the "washing tip" menu of the wash help is selected, the lower-level menus of the "washing tip" menu are displayed onto the LCD display unit 40 (step 558). Thus, step 558 corresponds to a case where the "checkpoint before washing" menu corresponding to a third menu among the lower-level menus of the "washing tip" menu is selected.

That is, the "checkpoint before washing" menu provides the user with the usage guidelines for the sorting and washability of laundry before loading the laundry into the washing tub and washing the laundry, for example, so that the user can check whether the laundry is washable and separate white fabrics from colored fabrics before washing. Thus, the user rotates the dial button to confirm the "checkpoint before washing" menu displayed onto the LCD display unit 40.

Further, according to the user's rotation of the dial button, the microcontroller 20 sequentially retrieves the usage guidelines of the "checkpoint before washing" menu stored in the memory 30, and causes them to be displayed onto the LCD display unit 40. Thus, in steps 560 to 574, the checkpoints before washing provided in the washing machine of the present invention are explained to the user. These checkpoints before washing are sequentially displayed onto the LCD display unit 40 in accordance with the rotation of the dial button.

Figure 17:
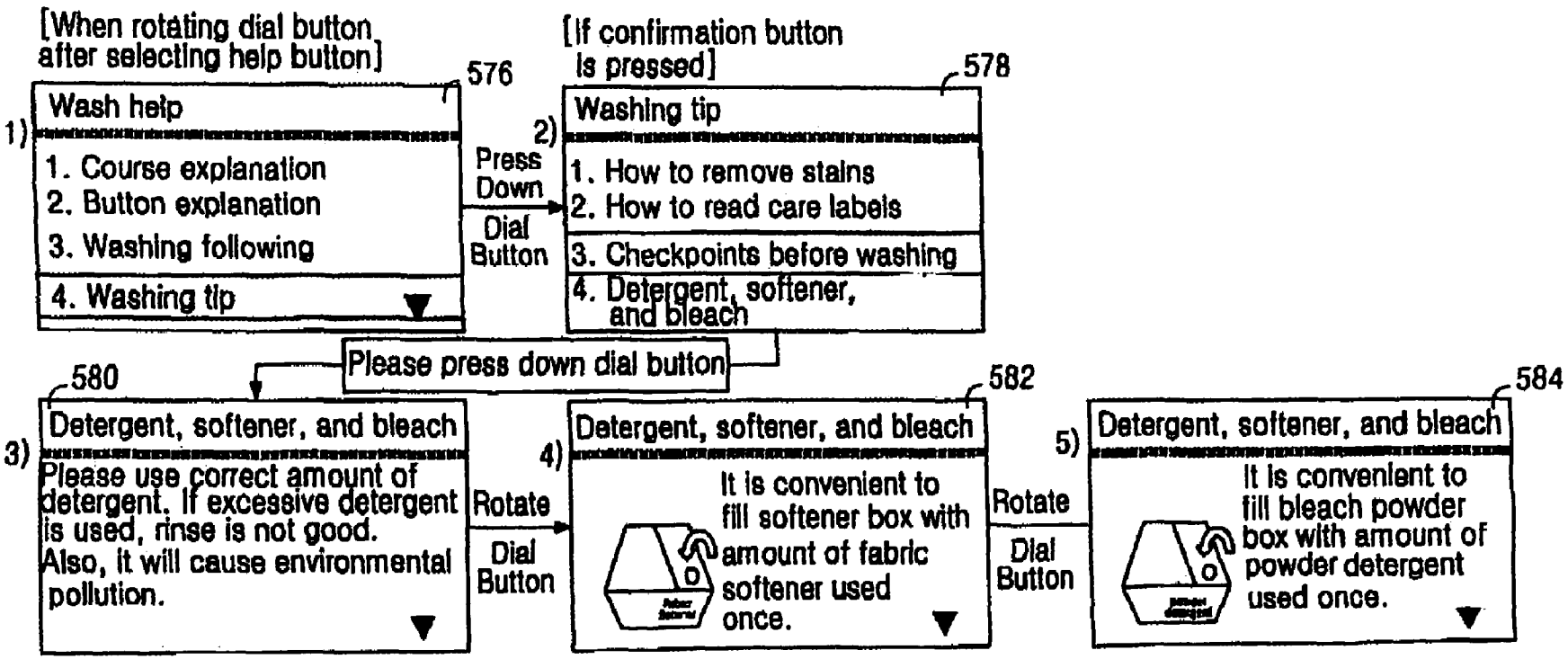

FIG. 17 is a procedural view for illustrating a "detergent, softener and bleach" menu corresponding to a further lower-level menu of the "washing tip" menu in the wash help.

If the user selects the help button in the signal input unit 10, the initial menu of the wash help is displayed (step 576). When the initial menu shown in step 576 is displayed, the user rotates the dial button to place the cursor (inverse image) onto the "washing tip" menu and presses down the dial button to select the "washing tip" menu.

If the "washing tip" menu of the wash help is selected, the lower-level menus of the "washing tip" menu are displayed onto the LCD display unit 40 (step 578). Thus, step 578 corresponds to a case where the "detergent, softener and bleach" menu corresponding to a fourth menu among the lower-level menus of the "washing tip" menu is selected.

That is, the "detergent, softener and bleach" menu illustrates usages of the detergent, softener and bleach and the amounts thereof used. Thus, the user confirms the desired contents of the "detergent, softener and bleach" menu displayed onto the LCD display unit 40 while rotating the dial button.

Further, according to the user's rotation of the dial button, the microcontroller 20 sequentially retrieves the usage guidelines of the "detergent, softener and bleach" menu stored in the memory 30, and causes them to be displayed onto the LCD display unit 40. Thus, in steps 580 to 584, the "detergent, softener and bleach" menu provided in the wash help is explained to the user. The usage guidelines of the "detergent, softener and bleach" menu are sequentially displayed onto the LCD display unit 40 in accordance with the rotation of the dial button.

That is, FIGS. 14 to 17 illustrate the processes of providing various information which is useful for washing.

Figure 18:
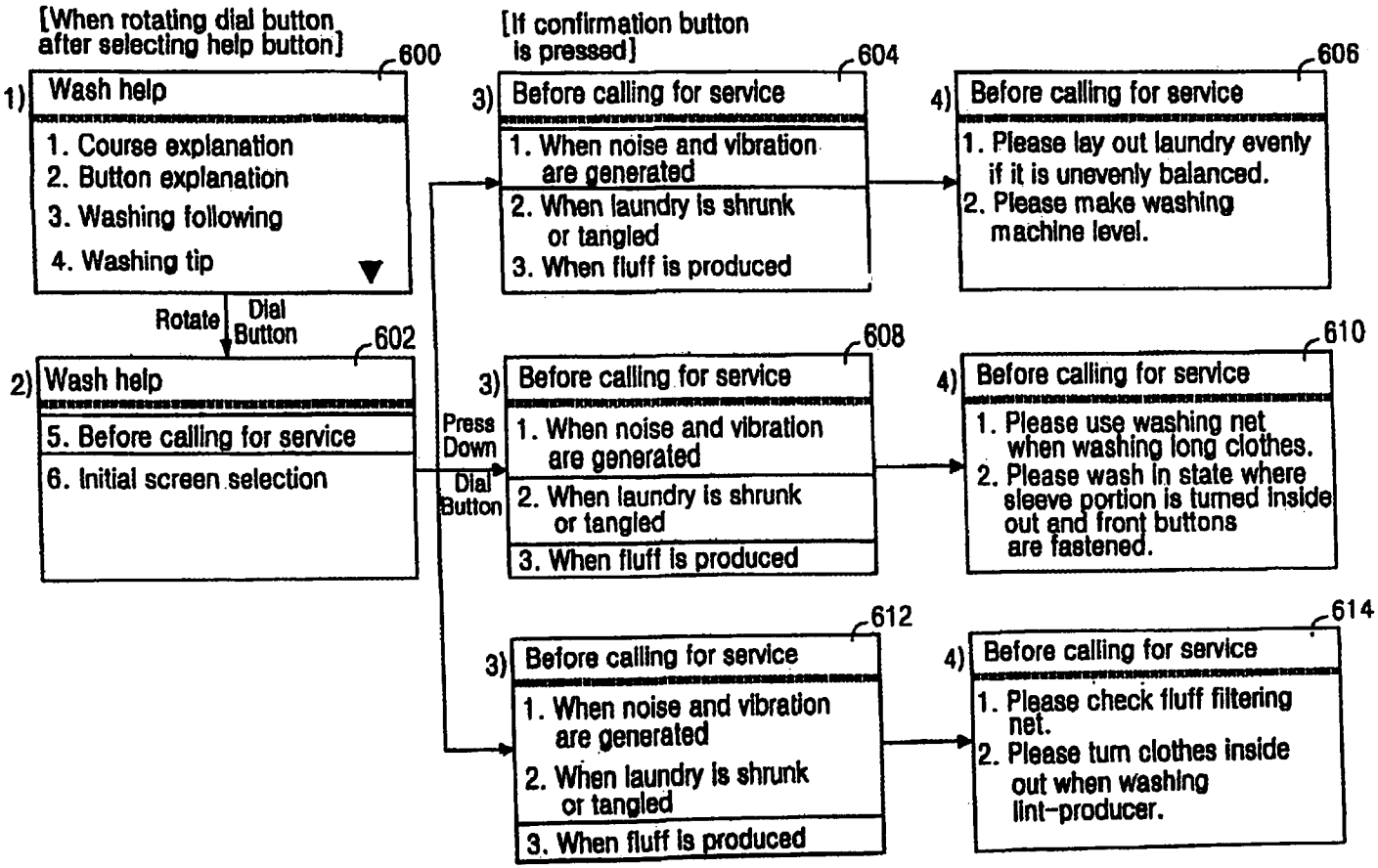
FIG. 18 is a procedural view for sequentially illustrating usage guidelines corresponding to a "before calling for service" menu of the wash help according to the present invention.

FIG. 18 is a procedural view for illustrating the operation of a "before calling for service" menu in the wash help.

If the user selects the help button in the signal input unit 10, the initial menu of the wash help is displayed (step 600). When the initial menu shown in step 600 is displayed, the user rotates the dial button to place the cursor (inverse image) onto the "before calling for service" menu and presses down the dial button to select the "before calling for service" menu.

If the "before calling for service" menu of the wash help is selected, the lower-level menus of the "before calling for service" menu are displayed onto the LCD display unit 40 (step 604). Thus, steps 604, 608 and 612 correspond to processes of selecting problem items occurring upon use of the washing machine.

Step 604 corresponds to a case where a "when vibration and noise are generated" menu is selected, and step 606 shows usage guidelines which are displayed onto the LCD display unit 40 when the "when laundry is shrunk or tangled" menu has been selected.

Step 608 corresponds to a case where a "when laundry is shrunk or tangled" menu is selected, and step 610 shows usage guidelines which are displayed onto the LCD display unit 40 when the "when laundry is shrunk or tangled" menu has been selected.

Step 612 corresponds to a case where a "when fluff is produced" menu is selected, and step 614 shows usage guidelines which are displayed onto the LCD display unit 40 when the "when fluff is produced" menu has been selected.

According to the user's rotation of the dial button, the microcontroller 20 sequentially retrieves the usage guidelines of the "before calling for service" menu stored in the memory 30, and causes them to be displayed onto the LCD display unit 40. Thus, steps 604 to 614 show the usage guidelines of the "before calling for service" menu provided in the wash help. The usage guidelines of the "before calling for service" menu are sequentially displayed onto the LCD display unit 40 in accordance with the rotation of the dial button.

That is, FIG. 18 illustrates the processes of guiding the user to checking stages so that the user can personally check and troubleshoot the problems related to the performance of the washing machine occurring in use.

Figure 19:
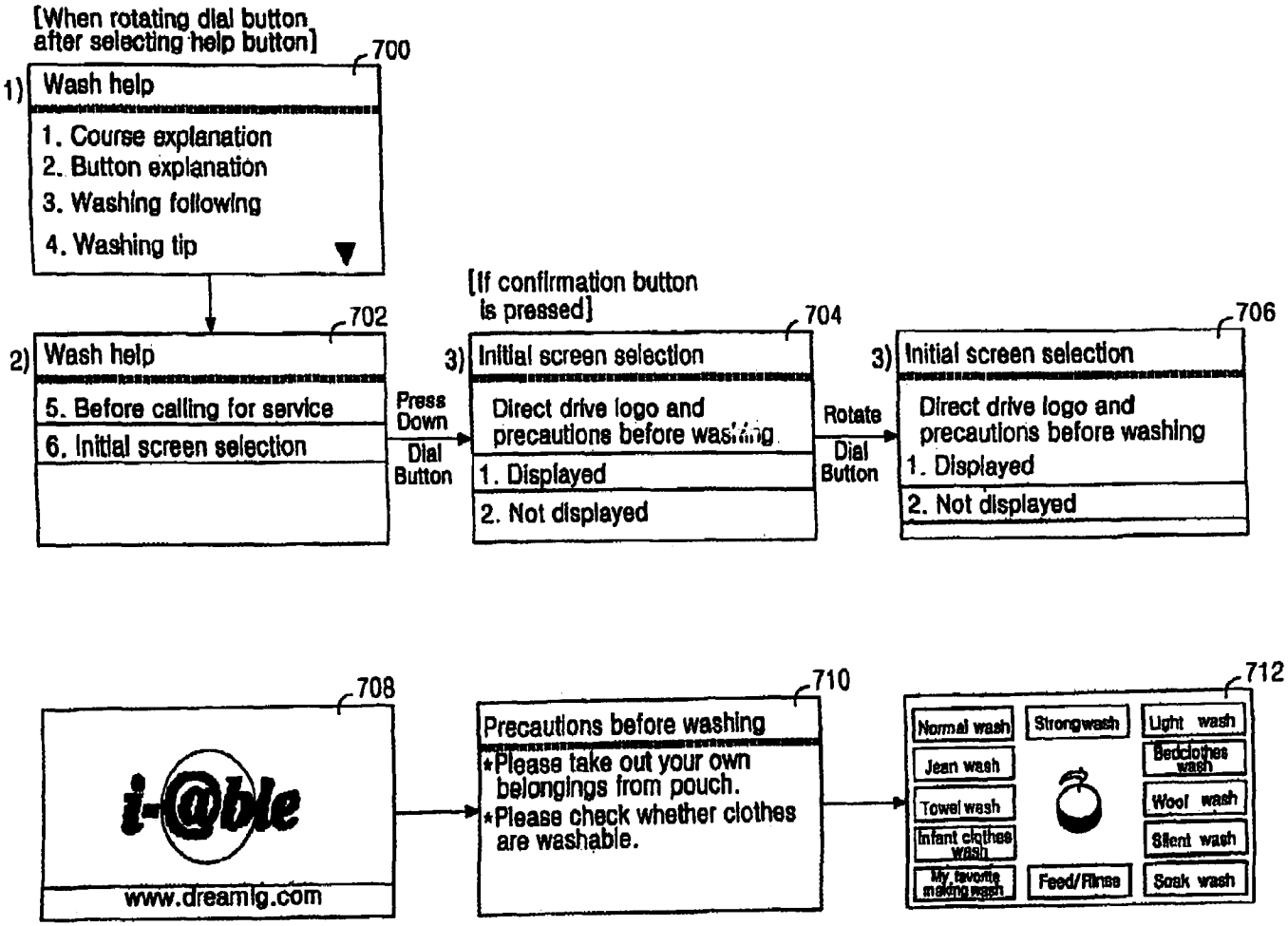
FIG. 19 is an operating flowchart for sequentially illustrating usage guidelines corresponding to an "initial screen selection" menu of the wash help according to the present invention.

Next, FIG. 19 is a procedural view for sequentially illustrating the operation of the "initial screen selection" menu in the wash help.

If the user selects the power button in the signal input unit 10 so as to supply the washing machine with the electric power, the code signal corresponding to the power button is inputted into the microcontroller 20. The microcontroller 20 recognizes by the inputted code signal that the user intends to utilize the washing machine. And then, the electric power is supplied to the respective components of the washing machine under the control of the microcontroller 20.

In addition, the microcontroller 20 retrieves the standby state capable of performing the washing from the memory 30 and causes the state to be displayed onto the LCD display unit 40. In such a case, an initial menu of a washing course capable of performing the washing process is generally displayed onto the LCD display unit 40. Alternatively, a logo in which the features of the washing machine are implied and data such as usage precautions may be displayed.

That is, in a state where the initial menu of the washing course is displayed onto the LCD display unit 40, the microcontroller 20 monitors whether signals for the next operation are inputted.

At this time, if the user selects the "help button" provided in the signal input unit 10, the microcontroller 20 recognizes that the user has selected the wash help, retrieves initial screen data on the wash help from the memory 30, and causes the initial menu screen of the wash help to be displayed onto the LCD display unit 40. That is, the state where the initial menu screen is displayed onto the LCD display unit 40 is shown in step 700 of FIG. 19.

As shown in step 700 of FIG. 19, in a state where the initial menu of the wash help is displayed, the user rotates the dial button to place the cursor (inverse image) onto the "initial screen selection" menu. That is, the state of the LCD display unit 40 where the cursor (inverse image) is placed onto the "initial screen selection" menu of the wash help is shown in step 702 of FIG. 19. Then, the user presses down the dial button to select the "initial screen selection" menu.

As shown in step 702 of FIG. 19, if the "initial screen selection" menu of the wash help is selected, the user determines whether to display an animation and precautions before washing (step 704 of FIG. 19) or not (step 706 of FIG. 19). That is, the user rotates the dial button to place the cursor (inverse image) onto the desired menu, and presses down the dial button to select the desired menu. According to the values set at this time, the microcontroller 20 controls the displaying state of the LCD display unit 40 which should occur just after the electric power has been supplied to the washing machine.

That is, if the user selects a "display" menu in step 704, the microcontroller 20 performs a preferential control for displaying the animation and the precautions onto the LCD display unit 40 just after the initial electric power has been supplied to the washing machine. However, if the user selects a "not display" menu in step 706, the microcontroller 20 performs a preferential control for displaying the initial menu screen of the washing course for starting the washing process onto the LCD display unit 40 just after the initial electric power has been supplied to the washing machine.

In other words, depending on whether the setting operation has been performed in step 704, when the user turns again on the power of the washing machine, the initial menu screen of the washing course may be displayed either after displaying the animations and the precautions before washing or directly without displaying the animation and the caution before washing.

Therefore, if the user has selected the "display" menu in step 704, the microcontroller 20 performs the process of displaying the animation such as shown in step 708 onto the LCD display unit 40 just after the power has been supplied to washing machine.

Then, after the animation has been displayed, the microcontroller performs the next stage for displaying a "precautions before washing" menu shown in step 710.

Thereafter, the microcontroller 20 performs the process of displaying the initial menu of the washing course for performing the washing process shown in step 712.

Further, if the user selects the washing course and presses down the operating button, the wash, rinse and spin processes selected by the user are sequentially performed.

However, if the user has selected the "not display" menu in step 706, the microcontroller 20 displays the initial menu screen of the washing course for starting the washing process onto the LCD display unit 40 together with supply of the power whenever the user turns on the power of the washing machine from now on. That is, just after the power has been supplied, step 712 is set as a starting stage and is then performed.

Thereafter, in the same manner as the foregoing, the wash, rinse and spin processes are sequentially performed in accordance with the washing course selected by the user after the operating button has been pressed down.

That is, according to the process of FIG. 19, the user can selectively determine whether to display the animation and the precautions before washing, which are automatically displayed onto the LCD display unit 40 of the washing machine when the user turns on the power of the washing machine. The animation expresses well the features of the washing machine of the present invention. In the meantime, there is inconvenience in that wash waiting time is increased since the same animation and the precautions are displayed whenever the user turns on the power of the washing machine. Thus, the above inconvenience can be overcome by setting the initial screen as such. Boredom of the user produced by repetition of the same contents can also be overcome. Accordingly, in order to shorten the wash waiting time or to overcome the boredom, the present invention allows the user to select the initial screen which is displayed when the electric power is supplied to the washing machine.

Figure 20:
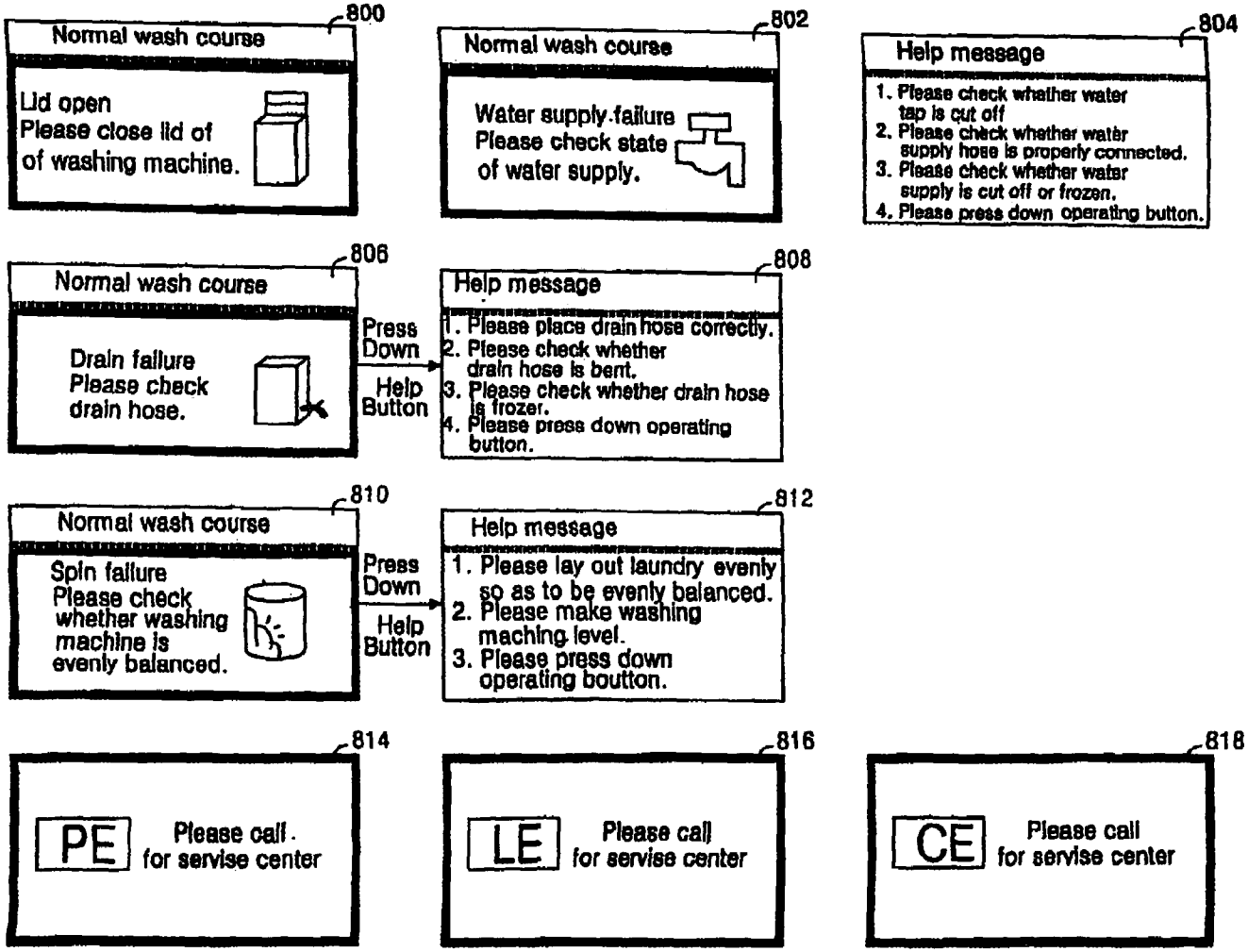
FIG. 20 is a view for illustrating various kinds of indications provided in the wash help according to the present invention.

Besides, the wash help of the present invention provides the user with usage guidelines of various kinds of indications such as shown in FIG. 20.

According to the present invention as described above, it should be understood that a basic technical feature of the present invention is that the usages of the washing machine by the respective stages are provided to the inexperienced person who does not know well the usages, and actual processes are performed when the user follows the provided instructions.

Further, another technical feature of the present invention is that the user can be guided in personally checking and troubleshooting the problems of the washing machine performance which may occur when utilizing the washing machine.

Furthermore, the present invention is characterized in that it can provide various kinds of information useful for washing and explanations of the respective course features provided in the washing machine.

It will be apparent that various changes or modifications may be made by those skilled in the art without departing from the technical spirit and scope of the invention.

INDUSTRIAL APPLICABILITY

As described above, it is understood that the following advantages can be obtained from the present invention.

According to the present invention, the inexperienced person who does not know well the usage of the washing machine can be informed of the usage with the aid of the wash help added to the washing machine itself. Thus, there is an advantage in that the user can conveniently refer to the usage guidelines without reading the owner's manual as before.

Further, according to the present invention, brief life information useful for washing is provided in addition to the usage of the washing machine, and a function of allowing the user to personally check the problems related to the washing machine performance is added to the wash help. Thus, there is another advantage in that the user can personally check and troubleshoot the simple problems which may occur when utilizing the washing machine.

Accordingly, various functions and usages provided in the washing machine can be more conveniently and efficiently utilized in the present invention. In addition, since the wash help is always in a standby state upon request of the user, it can be substantially useful to the user or consumer.

The invention claimed is:

1. A method for controlling a washing machine having an output unit which has a display screen for displaying information to a user, the method comprising:

displaying on the display screen a high level menu containing at least one user-selectable option;

receiving an indication of a selection of the at least one user-selectable option;

causing the display on the display screen to transition from a display of the high level menu to a display of a low level menu, different from the high level menu; and performing a function in accordance with the at least one user-selectable option.

2. The method as claimed in claim 1, wherein the high level menu includes two user-selectable options:

a first option to cause a display of a wash help menu which provides guidelines for using the washing machine; and a second option to cause a display of a course menu which lists a number of courses for washing laundry.

3. The method as claimed in claim 2, wherein a default menu is displayed when the washing machine is turned on.

4. The method as claimed in claim 1, further comprising the step of confirming the selected option before performing the function.

5. The method as claimed in claim 1, where the transition from the high level menu to the corresponding low level menu is sequential.

6. The method as claimed in claim 5, further comprising:

directly returning to the high level menu from the corresponding low level menu.

7. The method as claimed in claim 6, wherein the returning step is initiated using a mechanically activated input device.

8. The method as claimed in claim 7, wherein the input device is a button type device.

9. The method as claimed in claim 1, wherein a plurality of user-selectable options are displayed by scrolling.

10. The method as claimed in claim 9, wherein scrolling through the plurality of user-selectable options is achieved using a dial button.

11. The method as claimed in claim 1, wherein one of a plurality of high level menus is selectively displayed.

12. The method as claimed in claim 11, further comprising the step of transitioning directly from a first high level menu to a second high level menu.

13. The method as claimed in claim 12, wherein a mechanically activated input device is used to initiate the transition from the first high level menu to the second high level menu.

14. The method as claimed in claim 13, wherein the mechanically activated input device is a button type device.

15. The method as claimed in claim 5, wherein selecting one of the at least one user-selectable options is achieved using a dial button.

* * * * *